US010239583B2

(12) United States Patent
Kent

(10) Patent No.: US 10,239,583 B2
(45) Date of Patent: Mar. 26, 2019

(54) COVERING SYSTEM

(71) Applicant: Marine Concepts, LLC, Osage Beach, MO (US)

(72) Inventor: Randy Kent, Osage Beach, MO (US)

(73) Assignee: Marine Concepts, LLC, Osage Beach, MO (US)

( * ) Notice: Subject to any disclaimer, the term of this patent is extended or adjusted under 35 U.S.C. 154(b) by 191 days.

(21) Appl. No.: 14/976,685

(22) Filed: Dec. 21, 2015

(65) Prior Publication Data

US 2016/0107726 A1 Apr. 21, 2016

Related U.S. Application Data

(63) Continuation of application No. 13/633,122, filed on Oct. 1, 2012, now Pat. No. 9,216,798.

(51) Int. Cl.
*B63B 17/02* (2006.01)
*B63C 15/00* (2006.01)

(52) U.S. Cl.
CPC ..... *B63B 17/02* (2013.01); *B63C 15/00* (2013.01)

(58) Field of Classification Search
CPC .... A45B 2023/0037; A45B 2023/0075; B66C 23/005; B66C 23/02; B66C 23/022; B66C 23/16; B66C 23/166; B66C 23/203; B66C 23/36; B66C 2700/0307; E04H 6/025; E04H 6/04; E04H 15/04
USPC ..... 114/361; 135/90, 152; 212/233; 414/137.4, 744.2
See application file for complete search history.

(56) References Cited

U.S. PATENT DOCUMENTS

| | | | | |
|---|---|---|---|---|
| 670,831 | A | 3/1901 | Allen et al. | |
| 772,175 | A | 10/1904 | Palmer | |
| 1,133,429 | A | 3/1915 | Christensen | |
| 1,134,630 | A | 4/1915 | McGoldrick | |
| 1,547,915 | A * | 7/1925 | Hirn | B66C 23/203 248/230.5 |
| 2,045,587 | A | 6/1936 | Dean | |

(Continued)

FOREIGN PATENT DOCUMENTS

| | | |
|---|---|---|
| CA | 2088948 | 8/1994 |
| CA | 2266802 | 2/2000 |

(Continued)

*Primary Examiner* — Saul Rodriguez
*Assistant Examiner* — Brendan P Tighe
(74) *Attorney, Agent, or Firm* — Boyle Fredrickson S.C.

(57) ABSTRACT

A covering system for removably covering a vehicle, such as a boat, that includes a plurality of rotatively anchored swing arms rotatable between a covered position and an uncovered position. Each swing arm includes a mount and a pretensioner formed of one or more stays adjustably attached to part of a shaft of the arm to adjust an applied preload and transfer forces encountered during operation to part of the shaft rotatively anchored by the mount to a grounded structure such as a piling or post of a dock. The swing arms are pivotally connected to an elongate transversely extending carriage from which a cover is suspended with a boom of each arm connected to the carriage by a pivot assembly that also facilitates carriage and cover position adjustment. A pivot limiter can be included that limits or even stops pivoting of the carriage relative to the swing arm boom.

20 Claims, 14 Drawing Sheets

(56) References Cited

U.S. PATENT DOCUMENTS

| | | | | |
|---|---|---|---|---|
| 2,586,369 | A * | 2/1952 | Miller | B66C 23/205 212/176 |
| 2,688,973 | A | 9/1954 | Reiman | |
| 2,757,678 | A | 8/1956 | Stahl | |
| 2,965,084 | A | 12/1960 | Wallace | |
| 3,481,073 | A | 12/1969 | Yoshida et al. | |
| 4,084,599 | A | 4/1978 | Matthews | |
| 4,284,095 | A | 8/1981 | Norton | |
| 4,363,284 | A | 12/1982 | Monroe | |
| 4,448,224 | A | 5/1984 | Crain | |
| 4,560,074 | A * | 12/1985 | Manning | B66C 23/203 212/179 |
| 4,830,427 | A | 5/1989 | Fiocchi | |
| 4,991,612 | A | 2/1991 | Kiss et al. | |
| 5,086,799 | A | 2/1992 | Lumbleau | |
| 5,269,332 | A | 12/1993 | Osborne | |
| 5,709,501 | A | 1/1998 | Elbers | |
| 5,769,105 | A | 6/1998 | Margot et al. | |
| 5,775,353 | A | 7/1998 | Johnson | |
| 6,062,243 | A | 5/2000 | Tuch et al. | |
| 6,102,059 | A | 8/2000 | Miller | |
| 6,321,872 | B1 | 11/2001 | Parker | |
| 6,397,774 | B1 | 6/2002 | Pranger | |
| 6,786,171 | B1 | 9/2004 | Elbers | |
| 6,895,886 | B1 | 5/2005 | Pawlowski et al. | |
| 7,001,104 | B2 | 2/2006 | Edson | |
| 7,194,976 | B1 | 3/2007 | Kramer | |
| 7,455,026 | B2 | 11/2008 | Towley, III et al. | |
| 7,467,784 | B2 | 12/2008 | Turner | |
| 7,536,965 | B2 | 5/2009 | Johnson | |
| 8,601,971 | B2 | 12/2013 | Kent | |
| 8,783,276 | B2 | 7/2014 | Skrzynski et al. | |
| 8,911,174 | B2 | 12/2014 | Hey et al. | |
| 9,073,735 | B2 | 7/2015 | Byrd | |
| 9,187,923 | B2 | 11/2015 | Skrzynski et al. | |
| 9,216,798 | B2 * | 12/2015 | Kent | B63C 15/00 |
| 9,404,281 | B1 | 8/2016 | Donnay | |
| 9,409,628 | B2 | 8/2016 | Kent | |
| 2002/0083969 | A1 | 7/2002 | Tung | |
| 2003/0000154 | A1 | 1/2003 | Ignazio | |
| 2005/0089375 | A1 | 4/2005 | Fox | |
| 2005/0252542 | A1 | 11/2005 | Basta | |
| 2007/0068634 | A1 | 3/2007 | Unrast et al. | |
| 2008/0041431 | A1 | 2/2008 | Tung | |
| 2008/0042027 | A1 | 2/2008 | LaScala | |
| 2009/0178605 | A1 | 7/2009 | Tufte | |
| 2009/0293797 | A1 | 12/2009 | Kent | |
| 2011/0120514 | A1 * | 5/2011 | Skrzynski | B63B 17/02 135/90 |
| 2012/0180714 | A1 | 7/2012 | Bir, Jr. | |
| 2014/0001138 | A1 * | 1/2014 | Byrd | B66C 23/203 212/179 |

FOREIGN PATENT DOCUMENTS

| | | |
|---|---|---|
| CA | 2452636 | 6/2004 |
| EP | 661233 | 7/1994 |
| GB | 191210018 | 4/1913 |
| GB | 191211873 | 5/1913 |
| GB | 191416123 | 1/1915 |
| GB | 607313 | 8/1948 |
| GB | 997211 | 7/1965 |
| JP | 10292657 | 11/1998 |
| SE | 514452 | 2/2001 |
| WO | 9921753 | 5/1999 |
| WO | 2007082403 | 7/2007 |
| WO | 2008014264 | 1/2008 |

* cited by examiner

COVERING SYSTEM

CROSS REFERENCE TO RELATED APPLICATIONS

This application is a continuation of U.S. application Ser. No. 13/633,122, filed Oct. 1, 2012, which issued on Dec. 22, 2015, as U.S. Pat. No. 9,216,798, the entirety of which is expressly incorporated by reference herein.

FIELD

The present invention is directed to a covering system for removably covering an object, such as a vehicle, like a boat, with a removable cover, and more particularly to a covering system facilitating application, retention, and removal of such a cover.

BACKGROUND

While attempts have been made in the past to produce a covering system that is well suited for removably covering an object with a removable cover, it has remained a challenge to produce such a covering system that is strong, durable, easy to maintain, simple to use, economical to construct, and relatively quick and straightforward to install. While one such covering system disclosed in U.S. Patent Application Publication No. 2011/01250514 seeks to accomplish some of these objectives, improvements nonetheless remain desirable.

SUMMARY

The present invention is directed to a covering system for removably covering a relatively large object that preferably is a vehicle, such as a boat. The covering system includes a plurality of spaced apart swing arms from which a removable cover is suspended with the swing arms swung between a covered position where the cover can removably cover the boat and an uncovered position that moves the suspended cover away from the covered position, and away from the boat, to an out of the way position enabling access and use of the boat. Such a covering system can employ a plurality of pairs, i.e., at least three, of swing arms spaced apart along the length of the boat sought to be covered with the swing arms being rotated substantially simultaneously when moved between the covered and uncovered positions.

Each swing arm is formed of a shaft having an upwardly extending shaft section, e.g., pole, rotatively anchored to a fixed or grounded part of a structure, e.g., part of a dock, and having a generally outwardly extending shaft section, e.g., boom, carrying the cover. A mounting arrangement that can be formed of a plurality of vertically spaced mounts can be used to rotatively anchor the pole of each swing arm shaft to a grounded or fixed support post, e.g., piling, of the dock. Each mount can be a clamp mount carrying at least one of a plurality of rotary bearings with a lower most mount also carrying an axial thrust bearing. Each rotary bearing can be attached to part of the mount by an adjustable spacer enabling the distance each bearing is outwardly spaced to be adjusted.

One swing arm embodiment includes an adjustable pretensioner applying a preload to part of the swing arm shaft that employs at least one stay connected to part of the boom or pole and extends alongside the boom or pole toward an elbow of the shaft. To enable pretensioner adjustment of an applied preload, the at least one stay is adjustably connected at a position along the boom or pole whose location is selectively varied to change preload. A position-adjustable connector can be used to releasably fix the at least one stay in one of a plurality of positions along the boom or pole depending on what preload adjustment is desired.

One preferred pretensioner is an assembly having one stay adjustably connected to part of the pole extending upwardly alongside the pole toward the elbow and another stay adjustably connected to part of the boom extending generally horizontally alongside the boom toward the elbow. Such a pretensioner can include a pretensioner anchor that can be fixed to part of the swing arm shaft located between opposite ends of the shaft to which each stay is anchored. In one pretensioner, the anchor is disposed at or near the elbow. In such a pretensioner, the anchor can be provided by an elbow reinforcing brace.

One preferred swing arm embodiment includes an adjustable pretensioner having an anchor carried by the swing arm shaft between opposite ends of the shaft with one stay connected to part the boom at or adjacent a free end thereof extending along the boom toward an elbow of the shaft attaching to the anchor and another stay connected to part of the pole at or adjacent where the shaft is rotatively anchored extending upwardly along the pole toward the elbow also attaching to the anchor. Each stay can be attached to part of the anchor along a tangent of the anchor helping to better transfer forces from the boom along the stays and to the pole at or adjacent where pivotally anchored. Each stay and anchor can be disposed along an outboard side of the shaft that faces way from the cover producing a pretensioner that reinforces substantially the entire swing arm by transferring forces encountered during operation along the stays around the elbow from the boom to part of the pole rotatively anchored by the mounting arrangement to a fixed or grounded part of the structure.

Each swing arm is pivotally connected at or adjacent the free end of its boom to a carriage from which the cover is suspended, such as by a track carrying the cover. A preferred carriage is formed of an elongate substantially rigid carriage beam against which a pivot limiter carried by the boom of at least one of the swing arms abuts when limiting relative pivotal movement between the beam and at least the swing arm carrying the pivot limiter in at least one direction. One preferred carriage beam is formed of a pair of flanges between which a pivot knuckle of a pivot assembly extends that can include an adjustable stem used to attach the boom of each swing arm to the carriage. The carriage beam includes an end wall between the flanges disposed outwardly of the free end of the boom and pivot knuckle against which the pivot limiter abuts when opposing relative pivotal motion.

One preferred pivot limiter extends outwardly from the boom adjacent or alongside the pivot knuckle stem having a free end that acts as a stop that abuts against an inner surface of the end wall facing toward the boom when limiting relative pivotal movement. One such pivot stop is a bolt extending outwardly from the free end of the boom that can be rotated in one direction extending the end of the bolt farther outwardly toward the carriage beam end wall reducing the permitted amount of relative pivotal movement and rotated in an opposite direction to retract the bolt away from the end wall increasing the permitted amount of relative pivotal movement Such a covering system constructed in accordance with the present invention having three or more swing arms each pivotally connected to such an elongate substantially rigid carriage rotates all of the arms substantially simultaneously in one direction about a generally vertical rotational axis from the covered position to an uncovered position and substantially simultaneously in an opposite direction back to the covered position during use. Such a covering system equipped with one or more pivot limiting stops helps limit relative pivotal movement between the boom of each swing arm and the carriage while also helping to ensure the swing arms rotate substantially simultaneously in the same direction when being rotated toward or away from the covered and/or uncovered positions.

Where the swing arms are equipped with an adjustable pretensioner, an applied preload can be set during installation which can be adjusted during installation as well as later on during use. Such a pretensioner not only is used to desirably preload the swing arm but also reinforces the swing arm strengthening the shaft transferring forces encountered by the swing arm away from the boom, around the elbow, and to part of the pole that is rotatively grounded or fixed by the mounting arrangement to a grounded or fixed part of the structure to which the covering system is mounted.

These and other objects, features and advantages of this invention will become apparent from the following detailed description of the invention and accompanying drawings.

BRIEF DESCRIPTION OF THE DRAWINGS

One or more preferred exemplary embodiments of the invention are illustrated in the accompanying drawings in which like reference numerals represent like parts throughout and in which.

Figure 1:
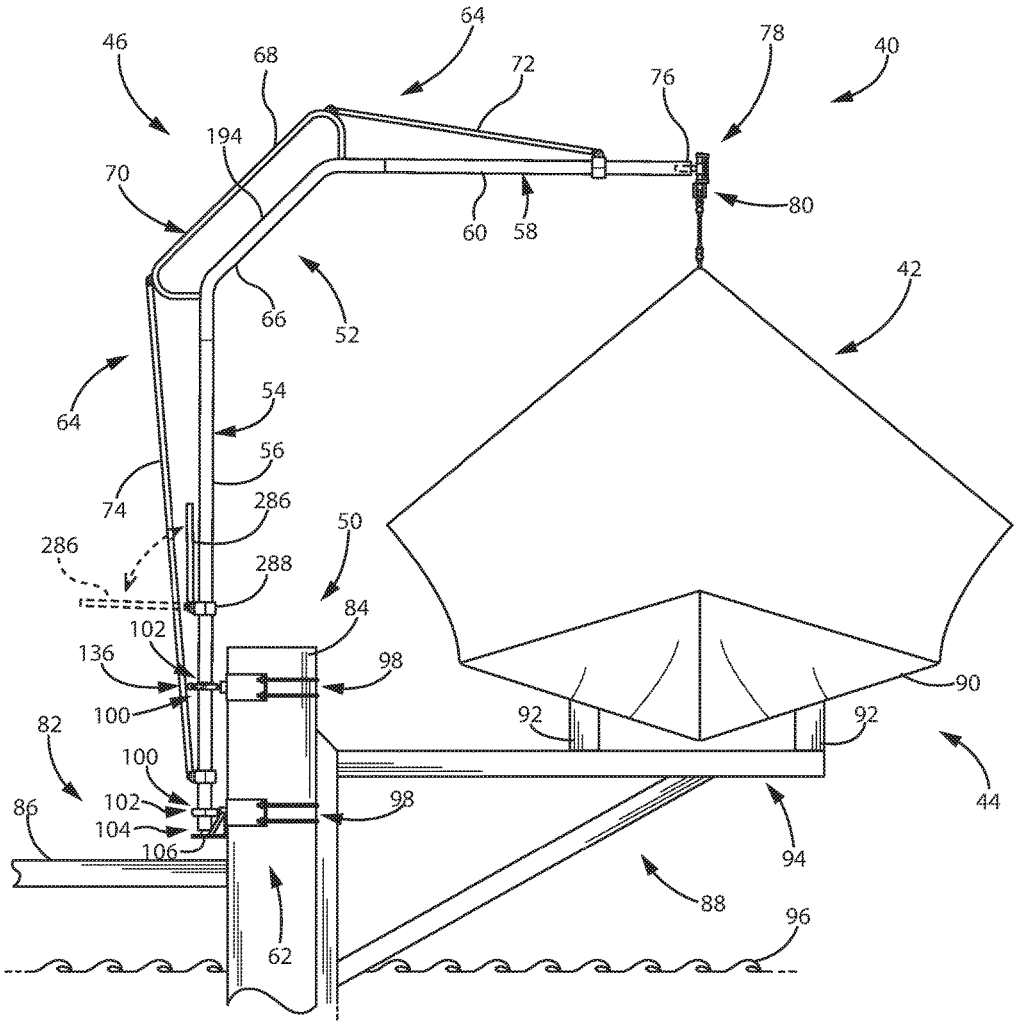
FIG. 1 is front elevation view of a covering system used to removably cover a boat with a boat cover showing the boat carried by a boat lift above water next to a dock to which the covering system is mounted.

Before explaining one or more embodiments of the invention in detail, it is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

Figure 2:
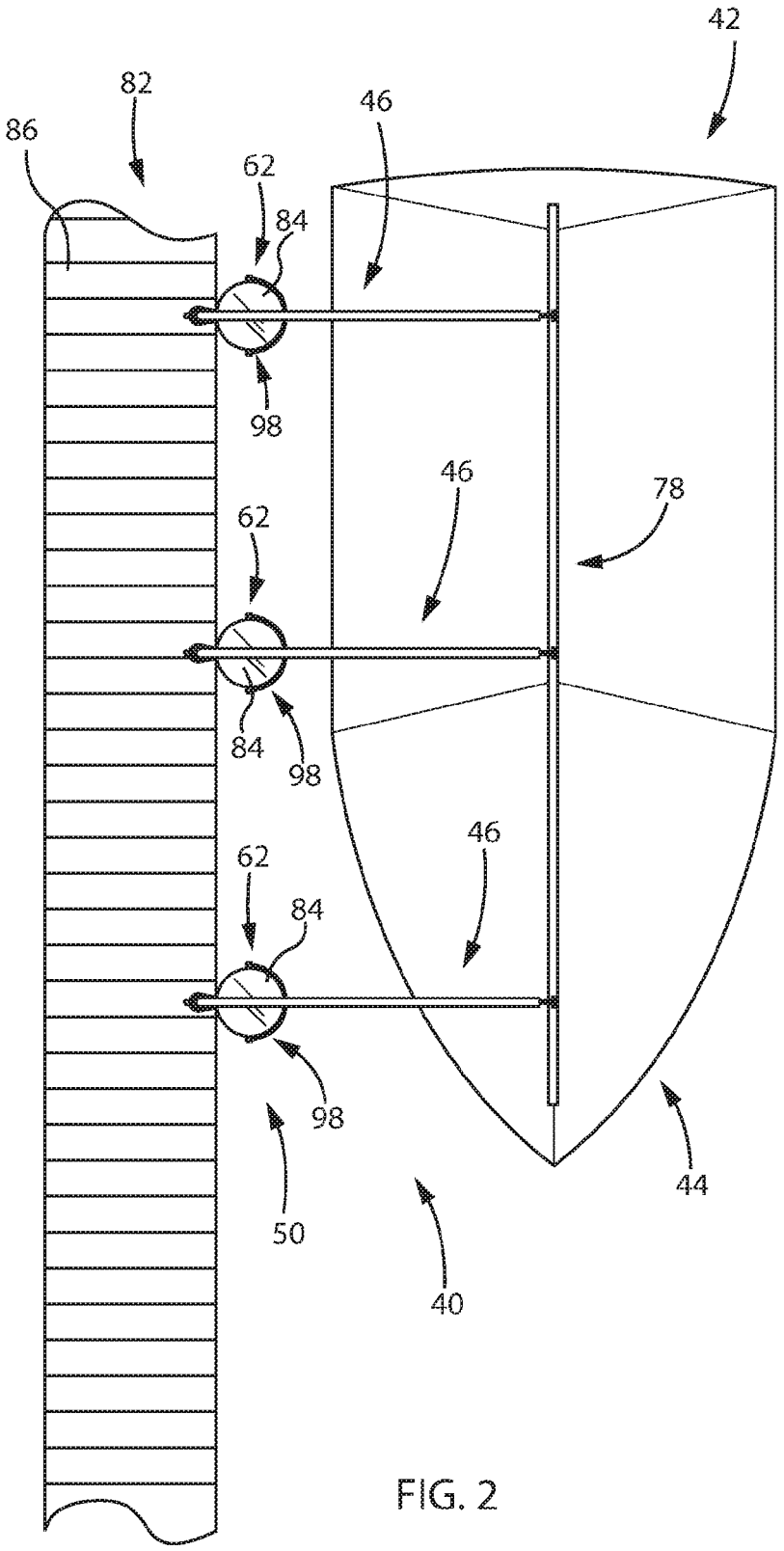
FIG. 2 is a top plan view of the covering system of FIG. 1 with the covering system in a covered position where the boat is removably covered with the cover.
Figure 3:
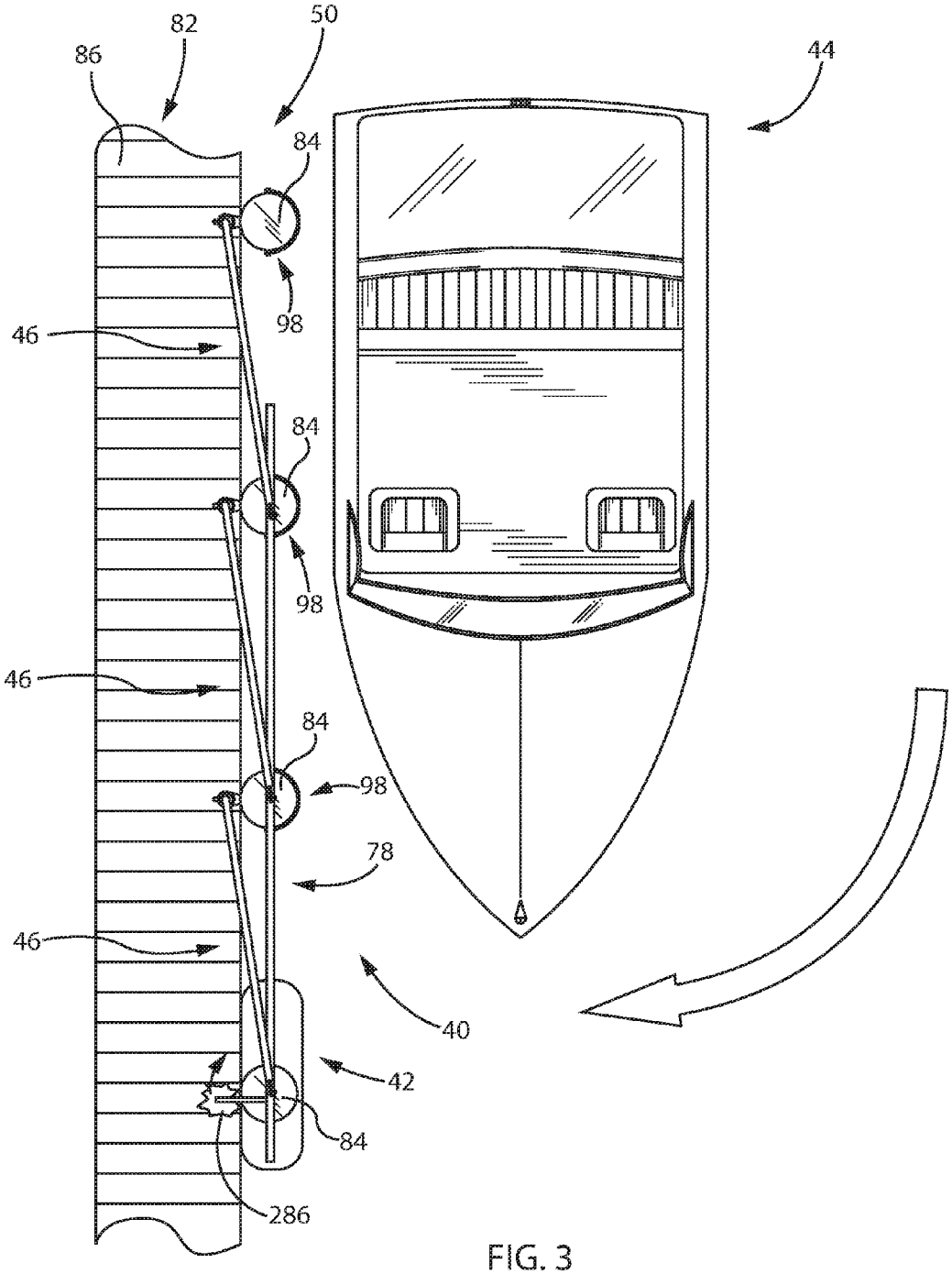
FIG. 3 is top plan view of the covering system of FIG. 1 where the cover has been removed from the boat and the covering system has been rotated from the covered position to an uncovered position.

FIGS. 1-3 illustrate a preferred embodiment of a covering system 40 that is used to hold a cover 42 suspended in place above an object 44 being removably covered by the cover 42 in a covered position, such as shown in FIGS. 1 and 2, and that is movable between the covered position and an uncovered position, such as shown in FIG. 3, when the cover 42 has been removed enabling access to the uncovered object 44. The covering system 40 includes a plurality of spaced apart rotatable swing arms 46 from which the cover 42 is suspended with each swing arm 46 rotatively anchored by a mounting arrangement 48 to a structure 50 located adjacent the object 44 to be covered by the cover 42. Such a covering system 40 typically includes at least a plurality of pairs, i.e., at least three, swing arms 46 spaced apart along the length of the object 44 that is to be covered with the cover 42 with the swing arms 46.

In use, all of the swing arms 46 are rotated substantially in unison between the covered position, where the cover 42 overlies the object 44, and an uncovered position, disposed from the covered position, where the object 44 is uncovered. When the cover 42 overlies the object 44, it can be manually covered with the cover 42 by a user or can be removed from the object 44 by the user. Once the cover 42 is removed, the swing arms 46 can be swung away from the covered position to an uncovered position where the cover 42 can be stowed in an out of the way position such as is depicted in FIG. 3.

With reference to FIG. 1, each swing arm 46 includes an elongate swing arm shaft 52 having a generally uprightly extending section 54, which serves as a generally vertical pole 56, and a generally outwardly extending section 58, which serves as a generally horizontally extending boom 60. The pole 56 of each swing arm 46 is rotatively mounted to part of the structure 50 by a mounting arrangement 62 attached to part of the structure 50. Each swing arm 46 includes a pretensioner 64 used to help strengthen the swing arm 46 including by helping to compensate for swing arm deflection caused by the weight of the cover 42 suspended therefrom. Such a pretensioner 64 can do so by applying a preload that can deflect part of the shaft 52 in one direction in a manner that offsets or counteracts deflection of the shaft 52 caused by the weight of the cover 42 and/or forces acting the cover 42 including while covering the object 44. The pole 56 and boom 60 of each swing arm shaft 52 are connected by an elbow 66 that can be reinforced by a brace 68 extending alongside the elbow 66 that can form part of the swing arm pretensioner 64. In a preferred embodiment, the elbow reinforcing brace 68 defines a pretensioner anchor 70 to which at least one and preferably a plurality of pretensioner stays 72, 74 are anchored.

A free end 76 of the boom 60 of each swing arm 46 is connected to an elongate generally horizontally extending carriage 78 from which the cover 42 is suspended. The carriage 78 can include or otherwise carry a track 80 from which the cover 42 hangs enabling the downwardly hanging cover 42 to be moved along the track 80 in one direction to extend the cover 42 when covering the object 44 when attaching the cover 42 to the object 44. Such a track 80 also enables the downwardly hanging cover 42 to be moved along the track 80 in the opposite direction after being removed from the object 44 to retract the cover 42 from the object 44 when uncovering the object 44. FIG. 2 shows the cover 42 in an extended position and FIG. 3 shows the cover 42 in a retracted position.

A covering system 40 constructed in accordance with the present invention is used to apply a cover 42 to an object 44, such as a vehicle, as well as to remove the cover 42 from the object 44. With continued reference to FIGS. 1-3, the object 44 being covered is a boat and the cover 42 is a boat cover. A preferred boat cover 42 with which the covering system 40 is particularly well suited for use includes a boat cover constructed in accordance with that shown and described in U.S. Patent Application Publication No. 2009/0293797 of commonly owned U.S. patent application Ser. No. 12/426,241, the entirety of which is hereby expressly incorporated by reference herein.

Each swing arm shaft 52 preferably is of tubular construction formed of one or more sections of pipe or tubing formed such as by bending to produce a generally L-shaped shaft 52. The vertically extending pole 56 of the shaft 52 of each swing arm 46 is rotatively anchored by a mounting arrangement 62 to a fixed or grounded part of a structure 50 that preferably is fixed or grounded in a manner that makes it substantially immovable.

Where the covering system 40 is used with a boat 44, the structure 50 to which the covering system 40 is mounted is a dock 82 (or pier) supported by a plurality of pilings or posts 84 that preferably are substantially immovably fixed or grounded in place. The generally vertically extending support posts 84 are spaced apart alongside a generally horizontal deck 86 of the dock 82 upon which a single person using the covering system 40 can stand and operate the covering system 40.

The covering system 40 can be used to removably hold a boat cover 42 in place over an elongate boat 44 held by a boat lift 88 of conventional construction that is disposed alongside a plurality of support posts 84 of the dock 82. As is best shown in FIG. 1, a hull 90 of the boat 44 rests on a pair of spaced apart bunks 92 of a cradle 94 of the lift 88 that is used to lower the boat 44 into water 96 underneath the boat 44 when it is desired to use the boat 44 and raise the boat 44 from the water 96 when it is desired to cover the boat 44.

Figure 4:
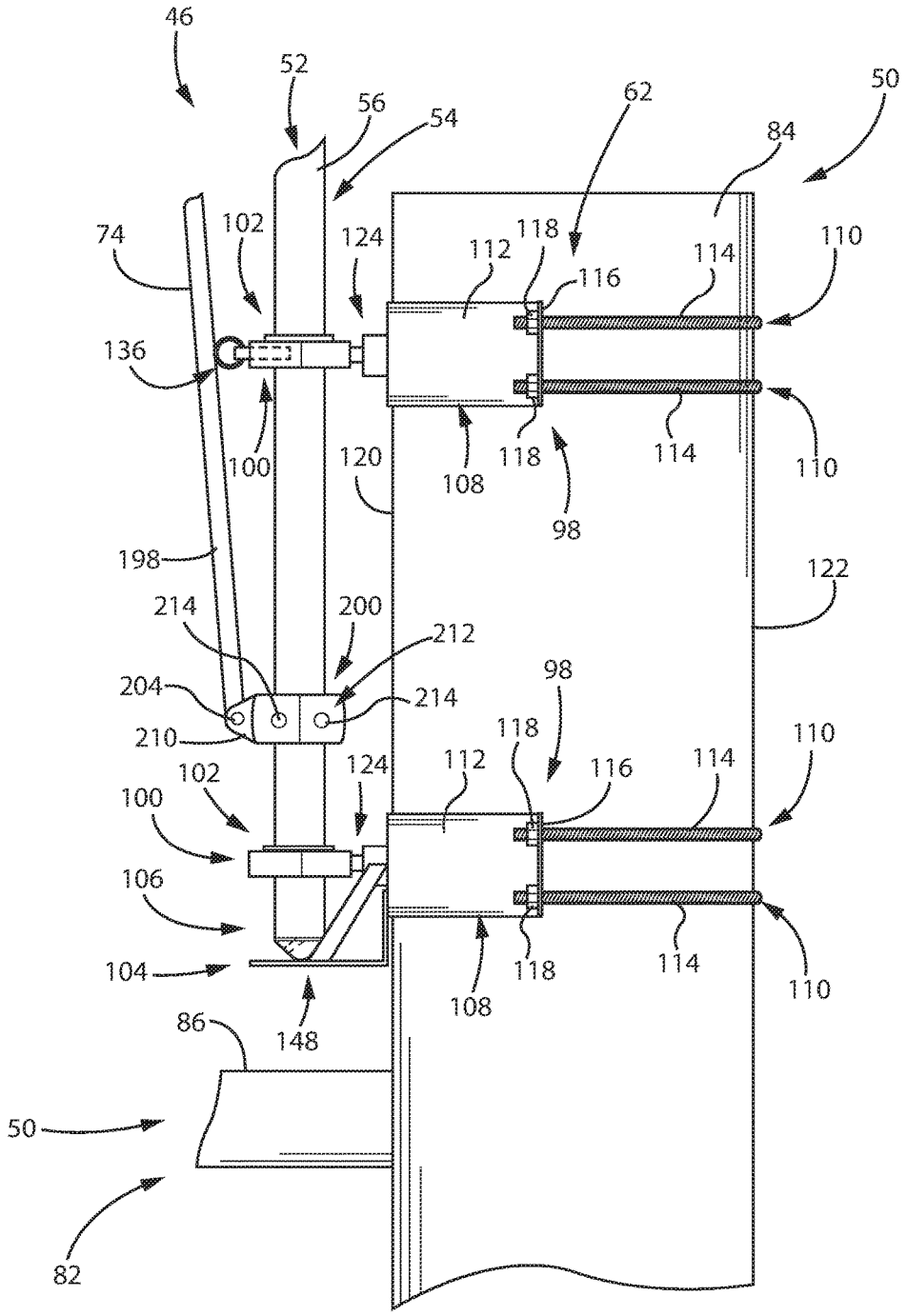
FIG. 4 is an enlarged fragmentary elevation view of a vertically extending bottom part of a shaft of the swing arm of the covering system depicting a mounting arrangement used to removably rotatively secure the swing arm to a piling of the dock.
Figure 5:
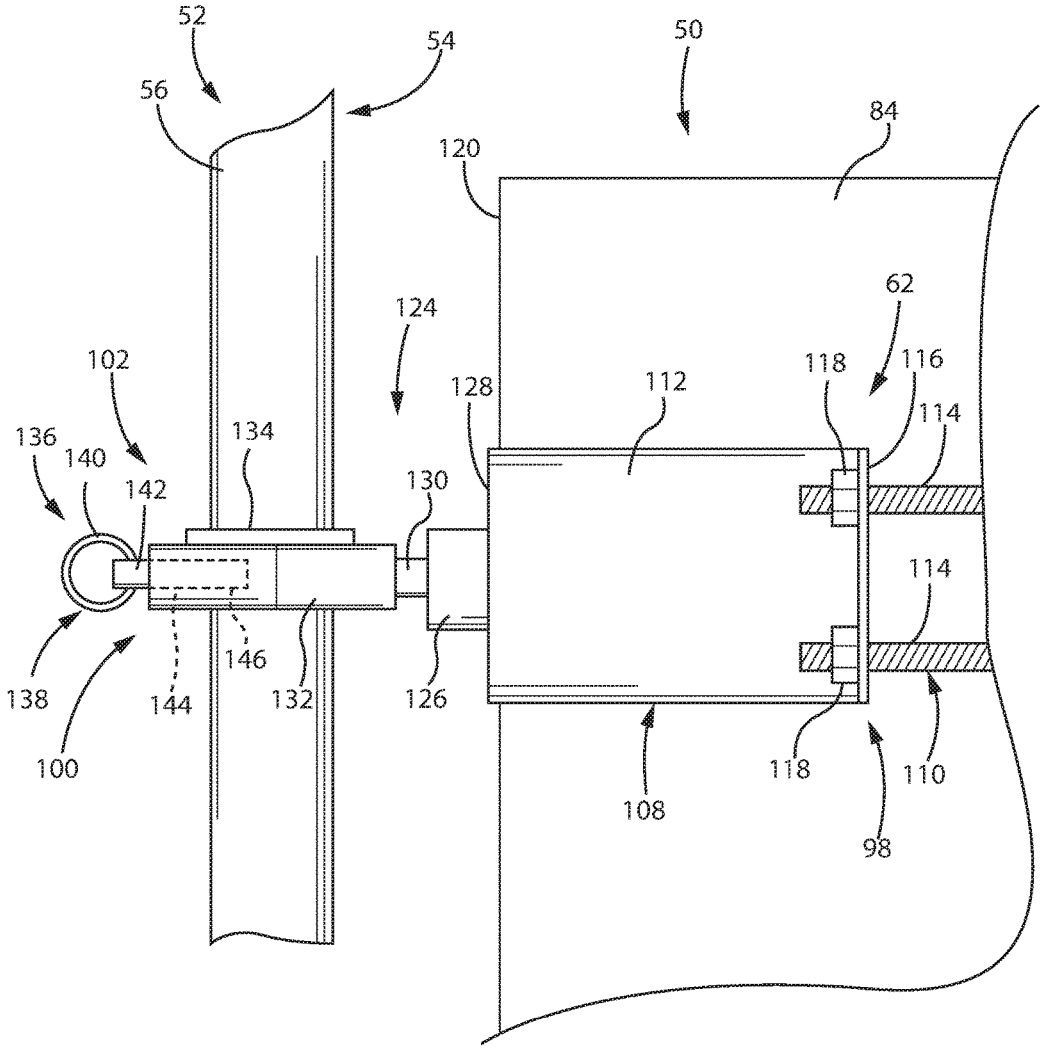
FIG. 5 is an enlarged fragmentary elevation view of the generally vertically extending bottom portion of the swing arm shaft illustrating in more detail a rotary swing arm holder secured by a clamp mount of the mounting arrangement to a dock piling.
Figure 6:
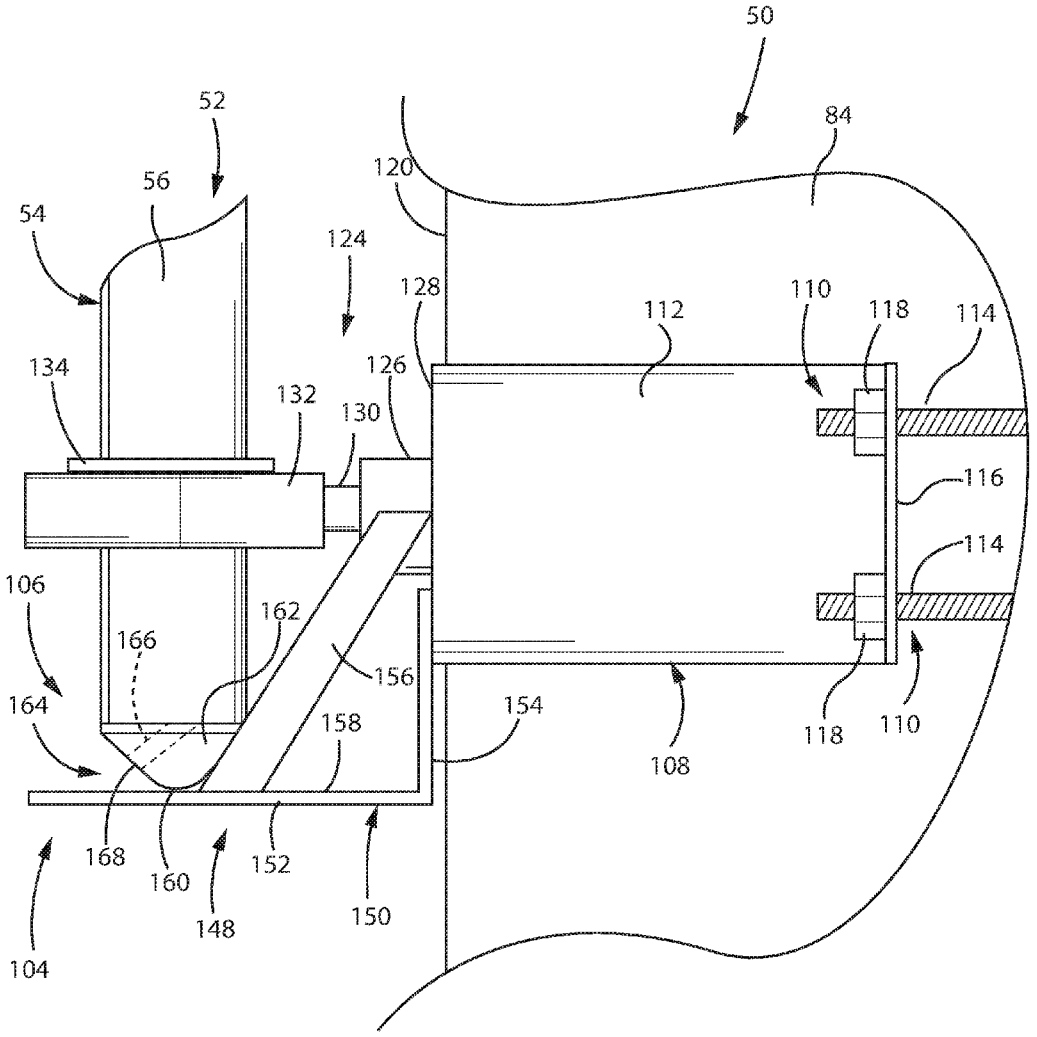
FIG. 6 is an enlarged fragmentary elevation view of a bottom-most portion of the swing arm shaft rotatively received in an axial thrust bearing cradle below another rotary swing arm holder secured by a lower-most clamp mount of the mounting arrangement to the dock piling.

With additional reference to FIGS. 4-6, where the covering system 40 is used to removably cover a boat 44, the shaft 52 of each swing arm 46 is rotatively anchored by a mounting arrangement 62 to a corresponding one of the dock support posts 84. Each mounting arrangement 62 is formed of a plurality of vertically spaced apart mounts 98 attached to each post 84. A swing arm shaft holder 100 journalled for rotation extends outwardly from each mount 98 and defines a rotary bearing 102 which removably receives and rotatively supports a lower portion of the vertically extending pole 56 of the swing arm shaft 52. The bottom-most mount 98 includes an axial thrust bearing 104 which receives and rotatively supports a bottom end 106 of the pole 56 of the shaft 52.

As is best shown in FIG. 4, each mount 98 is a clamp that removably clamps around the post 84 that is formed of a clamping bracket 108 removably secured to the post 84 by at least one and preferably a plurality of vertically spaced apart elongate clamping straps 110. The clamping bracket 108 of each mount 98 is a plate 112 that conforms to at least part of the shape of outer periphery of the post 84 to which the swing arm 46 is being mounted. Each generally rectangular clamping bracket plate 112 has a width greater than the width or diameter of the swing arm shaft 52 to help more securely and stably anchor the shaft 52 to post 84. Each strap 110 also conforms to at least part of the shape of the outer periphery of the post 84. Each strap 110 preferably is an elongate rod 114 that is threaded at least along opposite rod ends that extend through a corresponding bore (not shown) in a mounting flange 116 extending along each end of the clamping bracket 108 for being threadably secured thereto by a nut 118.

Where each dock support post 84 is a generally round or cylindrical wooden piling, like that illustrated in FIGS. 1-6, the clamping bracket 108 of each mount 98 is curved to substantially conform to an inwardly facing part 120 of the curved outer surface of the piling 84 that faces away from the boat 44 being covered using the covering system 40. Each rod 114 can be generally U-shaped, such as depicted in FIGS. 2-4, so as to substantially conform to an outwardly facing part 122 of the rounded outer surface of the piling 84 that faces generally outwardly away from the dock 82 toward the boat 44.

Each such clamp-type mount 98 encircles piling 84 and is clamped securely around piling 84 by tightening each nut 118 until the tension of each strap 110 pulls the clamp bracket 108 tightly against the piling 84 also tightly pulling each strap 110 against the piling 84. Each such clamp-type mount 98 advantageously attaches to piling 84 without requiring any hole to be drilled in the piling 84 and without needing any fastener that pierces or otherwise embeds in the piling 84.

Each swing arm shaft holder 100 is cantilevered from the mounting bracket 108 of its mount 98 by an adjustable spacer arm 124 that enables adjustment of the distance of each shaft holder 100 of mounting arrangement 62 away from piling 84 to substantially coaxially align the shaft holders 100. This facilitates generally vertical and substantially coaxial alignment of all of the shaft holders 100 of each mounting arrangement 62 which in turn enables the pole 56 of each swing arm shaft 52 of the covering system 40 to be oriented generally parallel with the pole 56 of every other swing arm shaft 52 of the covering system 40 during installation.

As is best shown in FIGS. 5 and 6, each adjustable spacer arm 124 can be formed of a threaded bung 126 fixed to a mounting surface 128 of the clamp bracket 108 from which an adjustable threaded stud 130 outwardly extends that carries shaft holder 100. Rotation of the threaded stud 130 selectively moves the shaft holder 100 toward or away from the piling 84 depending on the direction of rotation.

With continued reference to FIGS. 5 and 6, each shaft holder 100 has a collar 132 attached to stud 130 and includes a bushing 134 disposed between the collar 132 and part of the pole 56 of the swing arm shaft 52 received in the collar 132. The collar 132 can be generally cylindrical as can the bushing 134. If desired, bushing 134 can be a generally cylindrical sleeve at least partially telescopically received in the collar 132.

The bushing 134 is made of a friction reducing material facilitating relatively smooth and easy swing arm shaft rotation about a generally vertical axis of rotation during covering system operation. The bushing 134 can be made of plastic, such as nylon, a polyimide resin, acetal, acetyl, polytetrafluoroethylene, or the like, and can be of self-lubricating construction advantageously eliminating the need for periodic lubrication. The bushing 134 can also be made of another material, including a metal or metallic material, e.g., bronze, a composite, or a synthetic material which can also be of self-lubricating construction. The resulting shaft holder 100 defines a rotary shaft bearing 102 journalled for swing arm shaft rotation that lacks any grease fitting, e.g., lacks a Zerk fitting, which advantageously helps minimize covering system maintenance.

With specific reference to FIG. 5, at least one of the shaft holders 100 of at least one of the mounting arrangements 62 of the covering system 40 includes a releasable swing arm rotation lock 136 that prevents swing arm rotation when locked and allows swing arm rotation when unlocked. In a preferred embodiment, the swing arm rotation lock 136 is formed by a user removable pin 138 having a handle 140, e.g., lanyard, attached to an elongate stem 142 that is removably received in a bore 144 (shown in phantom in FIG. 5) formed in the collar 132 that is generally coaxially aligned with one of a plurality of radially spaced bores 146 (one of which is shown in phantom in FIG. 5) formed in the pole 56 of the swing arm shaft 52. When the pin 138 is removed, the rotation lock 136 is unlocked permitting swing arm rotation and when the pin 138 is inserted the rotation lock 136 is locked preventing swing arm rotation.

With specific reference to FIG. 6, an axial thrust bearing 104 extends outwardly from the bottom of each mounting arrangement 62 rotatively supporting the bottom 106 of the shaft 52 of the swing arm 46 rotatively anchored to the mounting arrangement 62. The axial thrust bearing 104 includes a cradle 148 formed of a generally L-shaped bearing bracket 150 having a shaft end supporting platform 152 cantilevered outwardly from a mounting plate 154 that extends downwardly from and along a bottom portion of the mounting surface 128 of the clamp bracket 108 of the lower-most mount 98. The cradle 148 also includes a pair of spaced apart structurally rigidifying gussets 156 (only one of which is shown in FIG. 6) straddling opposite sides of the platform 152 that each extends diagonally from the platform 152 to the bung 126 fixed to the clamp bracket 108. Each gusset 156 is fixed, such as by welding, to the platform 152 at or adjacent one end and fixed, such as by welding, to the bung 126 at or adjacent the opposite end. If desired, each gusset 156 can be fixed, such as by welding, to part of the clamp bracket 108 in addition to or instead of being fixed to the bung 126.

The axial or thrust bearing 104 includes an upwardly facing bearing support surface 158 of the platform 152 that can be substantially flat and which forms a relatively smooth reduced friction bearing surface on which the bottom end 106 of the swing arm shaft 52 is rotatively supported. The bottom end 106 of the swing arm shaft 52 is rounded or tapered to form a reduced bearing contact region 160 with the bearing support surface 158 producing a bearing contact region surface area less than the transverse cross-sectional surface area of the shaft 52. Such a bottom end 106 can be formed of a rounded or conical end cap 162. In the preferred swing arm embodiment shown in the drawings, a rounded or conical end cap 162 is fixed to the end of each swing arm shaft 52 rotating substantially in unison therewith.

As is also shown in FIG. 6, each axial or thrust bearing end cap 162 can and preferably does include an integrally formed drain 164 formed of a drain passage 166 (shown in phantom in FIG. 6) extending radially inwardly and upwardly in fluid flow communication with a hollow interior of the swing arm shaft 52. The drain passage 166 allows condensate and rain water to flow downwardly and outwardly out a drain hole 168 in the end cap 162 to drain water from inside the shaft 52.

Figure 7:
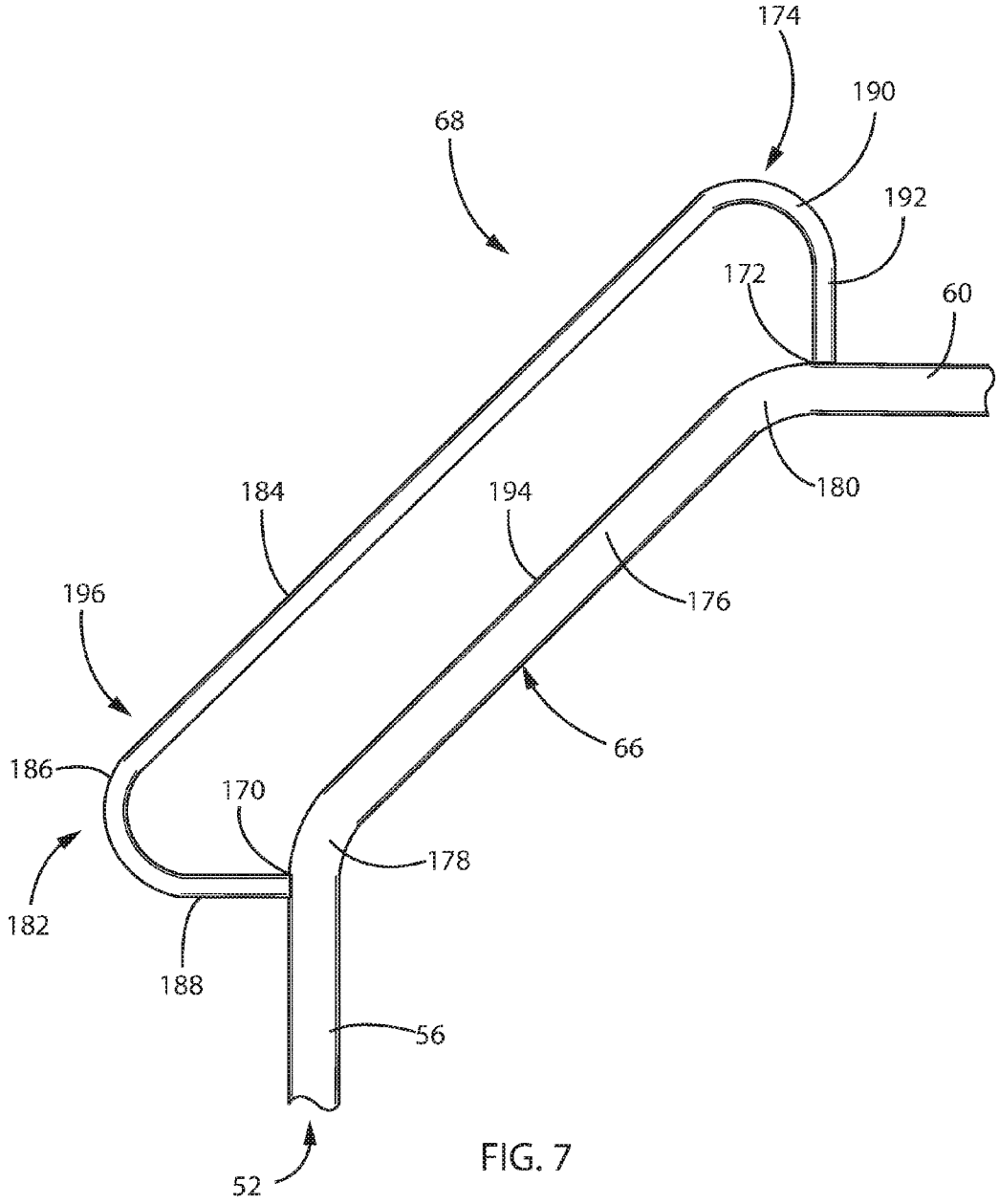
FIG. 7 is an enlarged fragmentary elevation view of part of the swing arm showing an elbow of the swing arm shaft and an elbow reinforcing brace.

Referring now to FIG. 7, each swing arm 46 can and preferably does include an elbow reinforcing brace 68 extending alongside the elbow 66 that is connected at a plurality of locations 170, 172 to the shaft 52 forming a force transfer loop 174 with the elbow 66 that can be oblong or generally oval in shape. In the preferred elbow reinforcing brace embodiment shown in the drawings, each end 170, 172 of the brace 68 is respectively fixed to part of the swing arm shaft 52, such as by welding, with one end 170 fixed to the upwardly extending pole 56 on one side of the elbow 66 and the other end 172 fixed to the horizontally extending boom 60 on the other side of the elbow 66.

During covering system operation, the brace 68 transfers some of the force applied to the boom 60, such as from the weight of the cover 42 and/or forces acting on the cover 42, through the brace 68 around the elbow 66 helping reinforce the elbow 66 and stiffen the swing arm 46. The force transfer loop 174 formed by the brace 68 and elbow 66 dynamically transfers forces encountered by the covering system 40 tending to bend the boom 60 downwardly and/or bend the pole 56 away from the boat 44 by the elbow 66 and brace 68 alternating between tensile and compressive loading thereof.

In the preferred swing arm 46 shown in the drawings, the elbow 66 of the swing arm shaft 52 is formed of an elongate elbow section 176 extending from a lower swing arm shaft bend 178 formed at the top end of the vertically pole 56 to an upper swing arm shaft bend 180 formed at the inner end of the generally horizontally extending boom 60. Such an elbow section 176 can be substantially straight and be diagonally angled helping to produce a stronger swing arm shaft elbow 66 that is better able to transfer forces and moments encountered by the boom 60 during covering system operation. Such a diagonally angled elbow section 176 preferably is disposed at about a 45° angle (45°±10°)

relative to horizontal and relative to one or both the pole 56 and boom 60. Such an elongate and substantially straight elbow section 176 also better cooperates with the elbow reinforcing brace 68 to more robustly withstand larger forces and bending moments encountered during covering system operation.

In the preferred embodiment shown in the drawings, the elbow reinforcing brace 68 is elongate and arched defining a curved spring 182 disposed in tension when the boom 60 is urged downwardly during covering system operation and disposed in tension when the boom 60 is urged upwardly. The brace 60 has an elongate leg 184 extending generally parallel to elbow section 176 having a lower bend 186 at one end connected by a generally horizontal leg 188 to the pole 56 of the swing arm shaft 52 at or adjacent one end of the elbow 66 and an upper bend 190 at an opposite end connected by a generally downwardly extending leg 192 to the boom 60 at or adjacent an opposite end of the elbow 66.

Where the brace 68 is attached to an outboard or outwardly facing side 194 of the swing arm shaft 52 that faces outwardly away from the cover 42, such as depicted in FIGS. 1 and 7, the brace 68 forms a stiffening backbone 196, or a portion of such a backbone 196, of the swing arm 46 that helps stiffen, strengthen and/or structurally rigidify the arm 46. With additional reference to FIG. 8, where the brace 68 forms part of the swing arm pretensioner 64, the brace 68 extends along the outboard or outwardly facing side 194 of the shaft 52 that faces outwardly away from the cover 42. Where the brace 68 forms part of the pretensioner 64, the brace 68 preferably forms a pretensioner anchor 70 fixed to the outboard side 194 of the shaft 52 from which pretensioner stays 72 and 74 oppositely outwardly extend.

Figure 8:
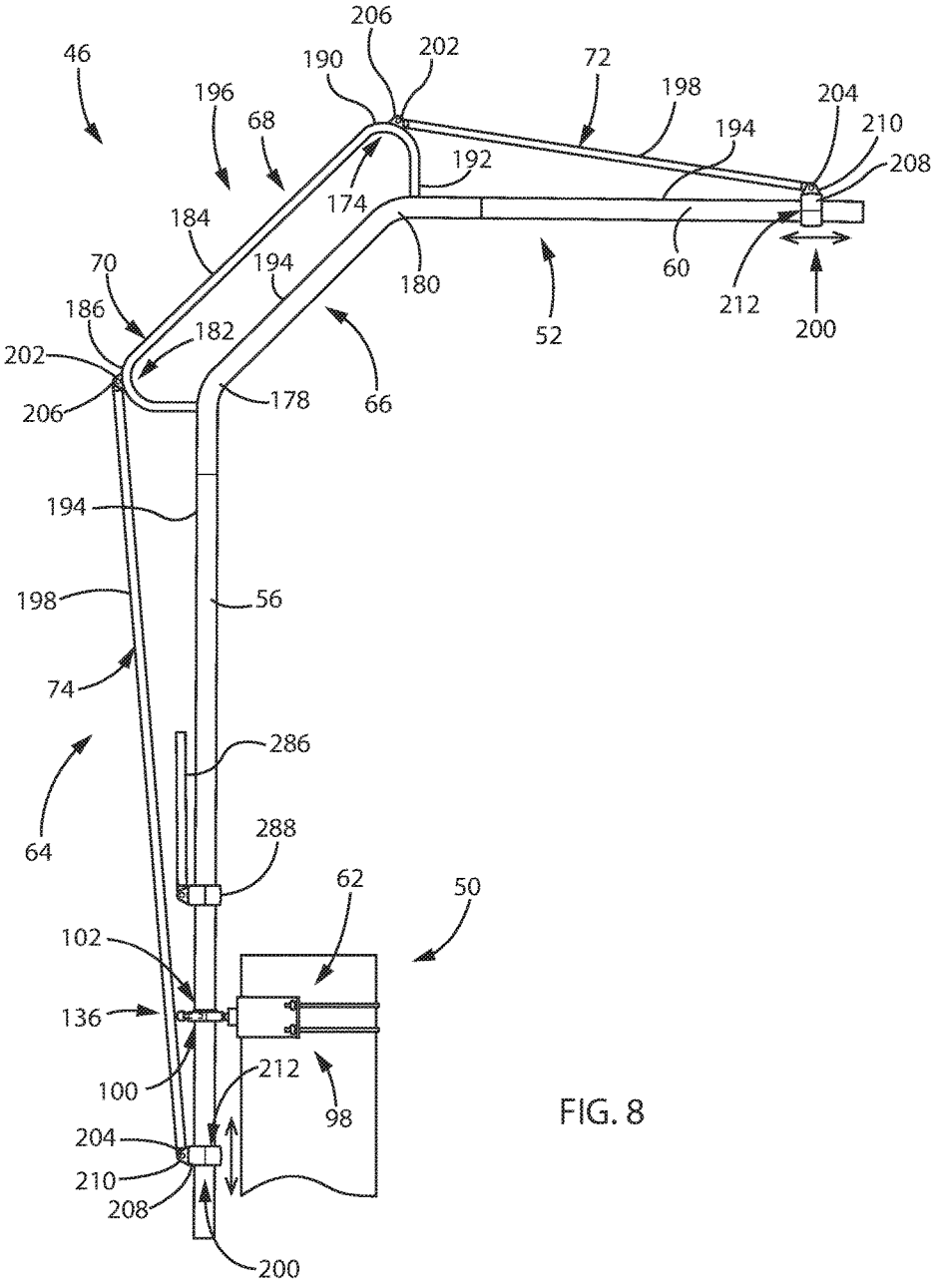
FIG. 8 is a fragmentary elevation view of part of the swing arm illustrating a pretensioner assembly attached to the swing arm shaft along an outboard side of the shaft.

The swing arm pretensioner 64 is best shown in FIGS. 1 and 8. The swing arm pretensioner 64 is an assembly that includes at least one pretensioner stay 72 or 74 and preferably a plurality of pretensioner stays 72 and 74 which are each adjustable in a manner that enables a preload to be selectively applied to the boom 60, the pole 56 or both the boom 60 and pole 56. Applying such a preload to the boom 60, pole 56 or both the boom 60 and pole 56 enables the distance between the boom 60 of each swing arm 46 and the boat 44 to be adjusted so they are at about the same height for all of the swing arms 46 of the covering system 40 in effect leveling out the carriage 78 and track 80. This not only helps distribute the weight of the cover 42 more evenly amongst all of the swing arms 46 of the covering system 40, it also helps prevent and preferably eliminate sagging of the cover 42 anywhere along the track 80. Such a swing arm pretensioner 64 can also and preferably does form part of a backbone 196 of each swing arm 46 further strengthening and stiffening the swing arm 46.

With reference to FIG. 8, each pretensioner stay 72 and 74 is an elongate connecting link 198 connected at one end to the pretensioner anchor 70 located on the outboard side 194 of the swing arm shaft 52 that faces away from the cover 42 and connected at its opposite end to part of the shaft 52 distal the anchor 70. Each stay 72 and 74 extends along the outboard side 194 of the respective part of the shaft 52 to which it is connected. In this regard, boom stay 72 extends along the outboard side 194 of the boom 60 that faces upwardly away from the boat 44 and dock 82 and pole stay 74 extends along the outboard side 194 of the pole 56 that faces outwardly away from the boat 44 when the swing arms 46 are disposed in the covered position.

Each stay 72 and 74 is adjustable so the amount or magnitude of preload, e.g., tension, applied to the boom 60, the pole 56 or both the boom 60 and pole 56 can be changed and adjusted as needed. Each stay 72 and 74 preferably is adjustable in a manner that enables the amount of preload applied by the stay 72 and/or 74 to a corresponding part of the swing arm shaft 52 to be adjusted as desired. The amount of preload applied by each stay 72 and/or 74 can deflect a corresponding part of the shaft 52 at least slightly in a controlled amount enabling the booms 60 of the swing arms 46 to be substantially leveled and can also help compensate for variations in the weight of the cover 42 at different points along the track 80.

The connecting link 198 of each stay 72 and 74 preferably is substantially rigid and can be formed of a rod, shaft, pipe or tube. The connecting link 198 of each stay 72 and 74 is pivotally connected at one end to the pretensioner anchor 70 and pivotally connected at its opposite end to part of the swing arm shaft 52. The link 198 of each stay 72 and 74 is adjustably attached to a respective part of the shaft 52 in a manner that enables not only the preload tension of the stay 72 and/or 74 to be adjusted but which also enables the preload tension the stay 72 and/or 74 applies to the shaft 52 to be adjusted. In a preferred embodiment, the link 198 of each stay 72 and/or 74 is adjustably connected to a respective part of the shaft 52 by a position adjustable connector 200 whose position along the swing arm shaft 52 can be changed to adjust the amount of preload.

Figure 9:
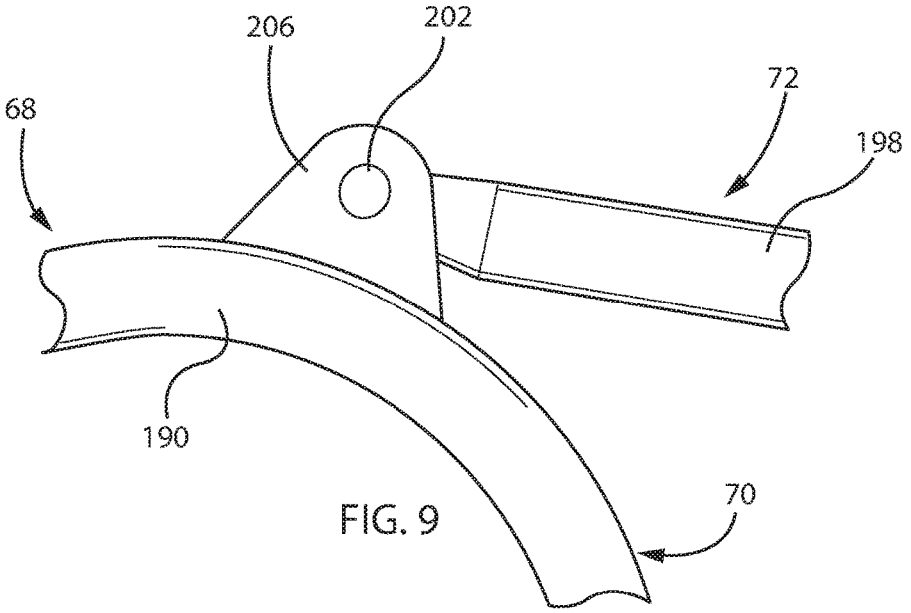
FIG. 9 is a fragmentary elevation view of part of the elbow reinforcing brace along with one end of a generally horizontally extending stay of the pretensioner pivotally tangentially attached to the brace.
Figure 10:
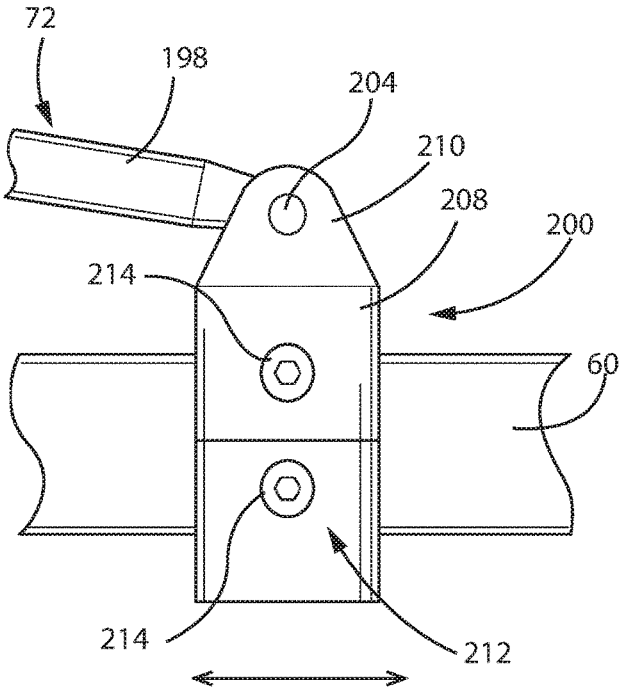
FIG. 10 is a fragmentary elevation view of part of the boom to which an opposite end of the generally horizontally extending stay is pivotally attached by a releasably lockable position-adjustable connector used to adjust pretensioner preload.
Figure 11:
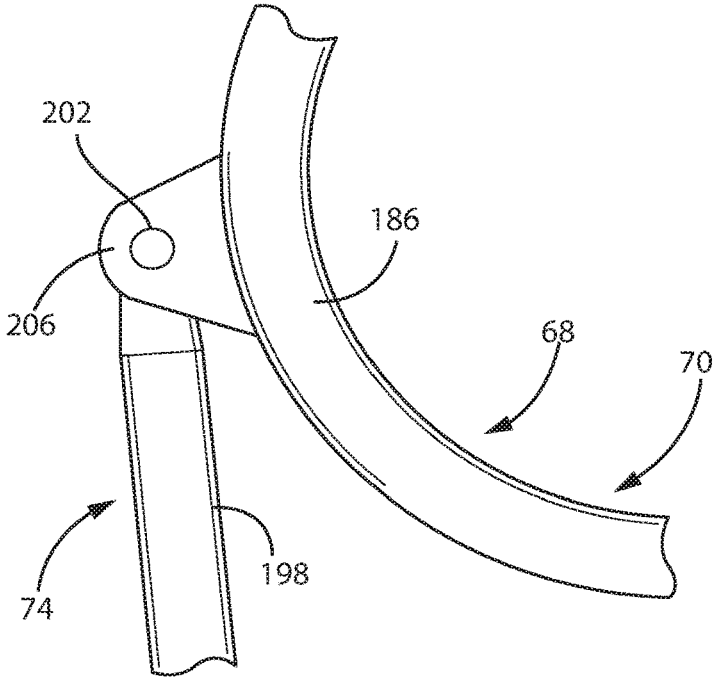
FIG. 11 is a fragmentary elevation view of another part of the elbow reinforcing brace along with one end of a generally vertically extending stay of the pretensioner pivotally tangentially attached to the brace.
Figure 12:
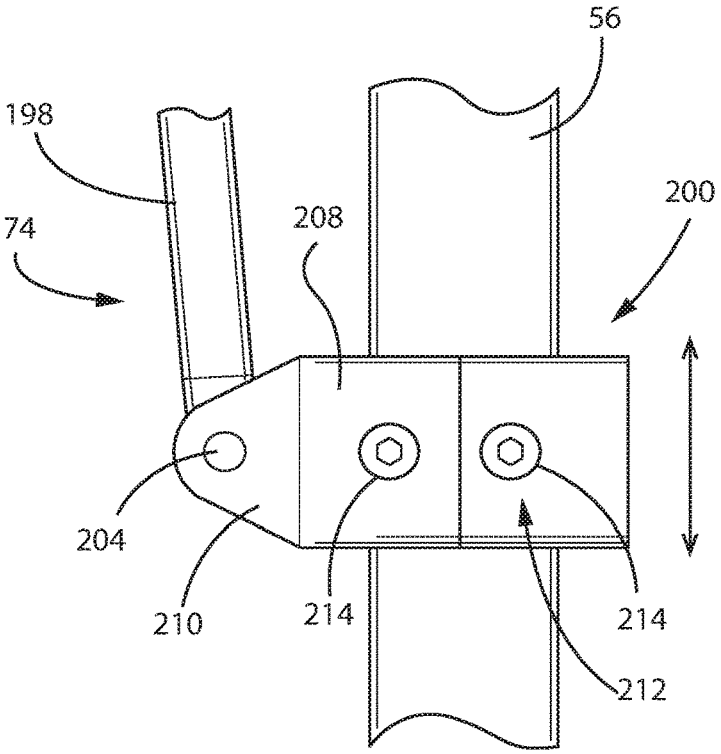
FIG. 12 is a fragmentary elevation view of part of the pole of the swing arm shaft to which an opposite end of the generally vertically extending stay is pivotally attached by a releasably lockable position-adjustable connector used to adjust pretensioner preload.

The connecting link 198 of the boom stay 72 is pivotally connected at one end to the pretensioner anchor 70, i.e., the elbow reinforcing brace 68, and pivotally connected at its opposite end to the boom 60 inboard of the free end 76 of the boom 60. With reference to FIGS. 8-10, the generally horizontally extending link 198 of the boom stay 72 preferably is connected at one end to the anchor 70 by a first pivot 202 and connected at its opposite end to the boom 60 by a second pivot 204. The anchor 70 has a mounting ear 206 fixed to the upper bend 190 of the brace 68 to which the link 198 of the boom stay 72 is pivotally connected by the first pivot 202. A first position-adjustable pretensioner stay anchor collar 208 is slidably telescopically mounted on the boom 60 and includes a fixed mounting ear 210 to which the link 198 of the boom stay 72 is pivotally connected by the second pivot 204.

The collar 208 has a position lock 212 that releasably locks or fixes the collar 208 in place on the boom 60 preventing relative movement therebetween setting the amount of boom preload. The position of the collar 208 along the boom 60 can be changed when unlocked enabling the collar 208 to slidably telescope along the boom 60 toward or away from the end 76 of the boom 60, such as in the manner depicted by the generally horizontal double-arrow line in FIG. 8. When the collar 208 is slidably telescopically moved relative to the boom 60 along the boom 60 outwardly toward the end 76 of the boom 60, a preload is applied that tends to deflect the swing arm shaft 52 in a manner that raises the end 76 of the boom 60 higher. When the collar 208 is slidably telescopically moved relative to the boom 60 along the boom 60 inwardly toward the opposite end 180 of the boom 60 toward the elbow 66, a preload is applied that tends to deflect the shaft 52 in a manner that lowers the end 76 of the boom 60. When the desired collar position is obtained, the collar 208 is locked or otherwise fixed to the boom 60 setting the amount of the applied boom preload.

In a preferred embodiment, the position lock 212 used to fix the collar 208 to the boom 60 setting the preload preferably is formed of at least one set screw 214, such as is best shown in FIG. 10, which threads into the collar 208 against the boom 60 to fix the collar 208 to the boom 60.

When it is desired to unlock the collar 208 to re-adjust preload, the screw 214 is loosened until the collar 208 can be moved relative to the boom 60 along the boom 60 enabling preload adjustment to be performed anytime. Such a position lock 212 can include a plurality of circumferentially spaced apart set screws 214 that each extend radially inwardly toward the boom 60 that engage against the boom 60 to lock the collar 208 in place.

The connecting link 198 of the pole stay 74 is likewise pivotally connected at one end to the pretensioner anchor 70, i.e., the elbow reinforcing brace 68, and pivotally connected at its opposite end to the pole 56 adjacent but above the bottom end 106 of the pole 56. The generally vertically extending link 198 of the pole stay 74 preferably is connected at one end to the anchor 70 by a first pivot 202 and connected at its opposite end to the pole 56 by a second pivot 204. The anchor 70 has a mounting ear 206 fixed to the lower bend 186 of the brace 68 to which the link 198 of the pole stay 74 is pivotally connected by the first pivot 202. A second position-adjustable pretensioner stay anchor collar 208 is slidably telescopically mounted on the pole 56 and includes a fixed mounting ear 210 to which the link 198 of the pole stay 74 is pivotally connected by the second pivot 204.

The collar 208 also has a position lock 212 of like construction that releasably locks or fixes the collar 208 in place on the pole 56 preventing relative movement therebetween setting the amount of pole preload. The position of the collar 208 along the pole 56 can be changed when unlocked enabling the collar 208 to slidably telescope along the pole 56 toward or away from the bottom end 106 of the pole 56, such as in the manner depicted by the generally vertical double-arrow line in FIG. 8. When the collar 208 is slidably telescopically moved relative to the pole 56 along the pole 56 downwardly toward the bottom end 106 of the pole 56, a preload is applied that tends to deflect the swing arm shaft 52 in a manner that moves the top of the pole 56, elbow 66 and boom 60 away from the boat 44 when in the covered position. This can also raise the end 76 of the boom 60 higher. When the collar 208 is slidably telescopically moved relative to the pole 56 along the pole 56 upwardly toward the opposite end 178 of the pole 56 toward the elbow 66, a preload is applied that tends to deflect the shaft 52 in a manner that moves the top of the pole 56, elbow 66 and boom 60 toward from the boat 44 when in the covered position. This can also lower the end 76 of the boom 60. When the desired collar position is obtained, the collar 208 is locked or otherwise fixed to the pole 56, such as in the manner previously discussed above, setting the amount of the applied pole preload.

When the preload has been set by fixing each collar 208 of each stay 72 and 74 in place, the stays 72 and 74 of the pretensioner 64 cooperate with the elbow reinforcing brace 68 that also serves as the pretensioner anchor 70 producing a swing arm reinforcing backbone 196 that not only includes the brace 68 but which also includes each stay 72 and 74. Such a backbone 196 stiffens and strengthens substantially the entire swing arm shaft 52 defining a swing arm strengthening backbone 196 that strengthens substantially the entire swing arm 46.

During covering system operation, the boom stay 72 helps transfer at least some of the forces and bending moments through brace 68 to the pole stay 74 where they are transferred back to the shaft 52 at or near the rotatively anchored bottom end 106 of the pole 56 between a pair of the swing arm shaft holders 100. Transferring at least some of forces and bending moments to part of the pole 56 that is rotatively anchored to the fixed support posts 84 of the structure 50 to which the covering system 40 is attached advantageously transfers a substantial amount of these forces through the swing arm holders 100 to the grounded posts 84. This advantageously produces a swing arm 46 that is lighter but yet strong enabling a single person to not only rotate the swing arms 46 during covering system operation but also to remove each swing arm 46 one at a time of their holders 100 when stowing the covering system 40.

In the preferred embodiment shown in the drawings, the end of the boom stay 72 attached to the elbow reinforcing brace 68 is attached at or along a tangent of where the upper bend 190 of the brace 68 connects to the backbone leg 184 of the brace 68 helping to more directly transfer forces from the boom stay 72 to the backbone leg 184 helping maximize the magnitude of forces transferred around the boom 60 and elbow 66. Such a tangent connection helps ensure forces transferred from the boom stay 72 are substantially in line with the backbone leg 184 of the brace 68 to more efficiently transfer such forces. Likewise, the end of the pole stay 74 attached to the elbow reinforcing brace 68 is also attached at or along a tangent of where the lower bend 186 connects to the backbone leg 184 of the brace 68 helping to more directly transfer forces from the brace 68 to the mounting arrangement 68 that is grounded to structure 50. This arrangement also helps better counteract bending moments via the force transfer backbone produced by the boom stay 72, backbone leg 184 of the brace 68, and pole stay 74 generally being in line with one another ultimately producing moment opposing forces that are transferred to the swing arm shaft 52 at the bottom of the shaft 52 between a pair of the shaft holders 100 anchored by mounts 98 grounded to substantially immovable fixed support posts 84 of the structure 50, e.g., dock 82, to which the covering system 40 is mounted.

FIGS. 13-16 illustrates a preferred embodiment of the cover carriage 78 in more detail that pivotally connects each boom 60 of each swing arm 46 of the covering system 40 in a manner that not only helps accommodate some movement of the cover 42 during operation, it also helps to more evenly spread forces acting on the cover 42 amongst the swing arms 46. The carriage 78 is pivotally connected the boom 60 of each swing arm 46 by a pivot assembly 216 that includes a pivot limiter 218 that not only limits how far the carriage 78 can pivot relative to the boom 60 but which also ensures that all of the swing arms 46 of the covering system 40 rotate in the same direction when being rotated from the covered position toward an uncovered position. The carriage 78 extends generally transversely relative to the swing arms 46 when the covering system 40 is in the covered position. The carriage 78 pivotally connects all of the swing arms 46 in a manner where the swing arms 46 rotate substantially in unison in the same direction when being rotated between the covered position and an uncovered position.

Figure 13:
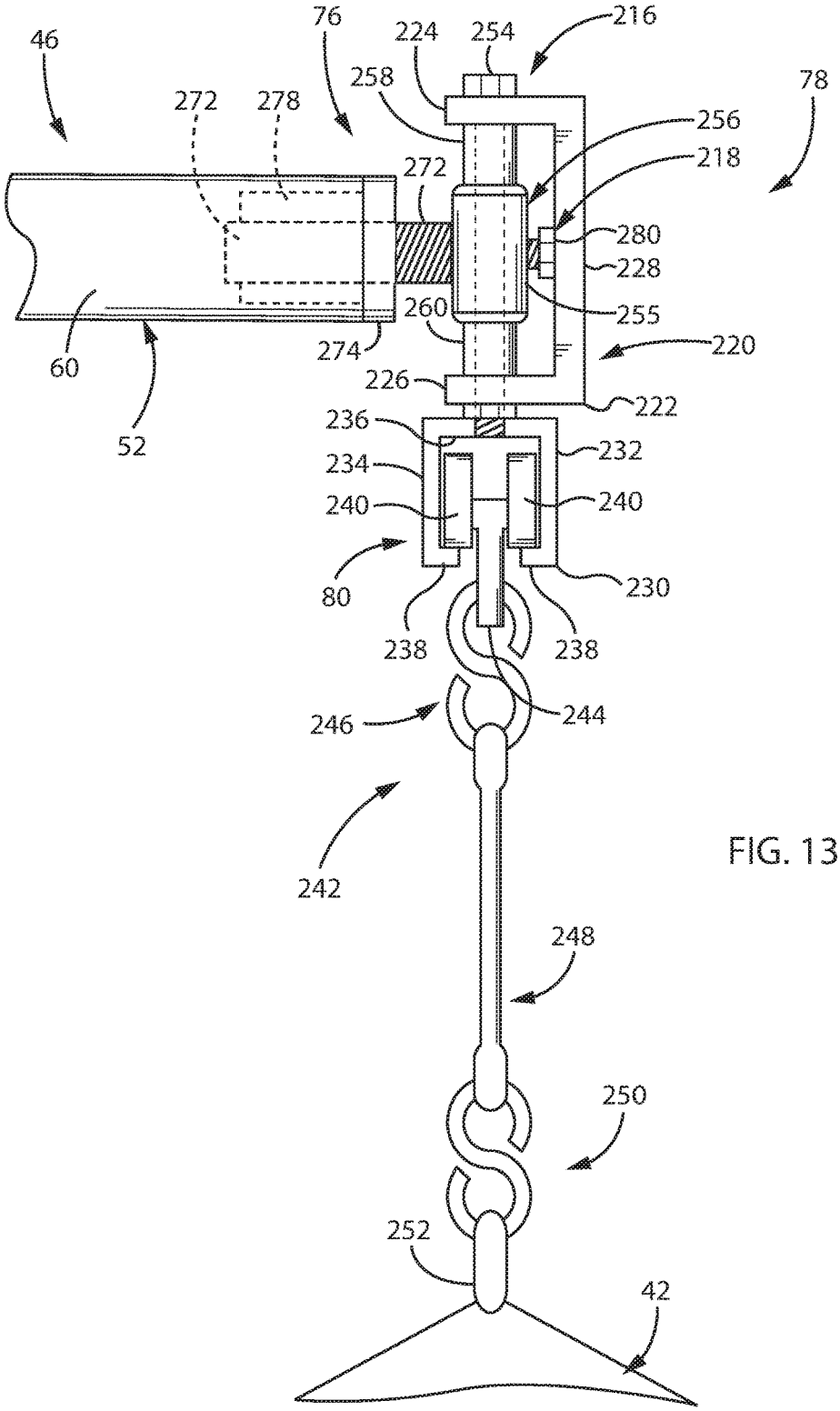
FIG. 13 an end view of a swing arm carriage pivotally connected by a pivot assembly to an end of the boom of one of the swing arms of the covering system with a pivot limiter in a pivot stop position abutting part of the carriage preventing relative pivotal movement between the boom and carriage in at least one direction about a generally vertical pivot axis.
Figure 14:
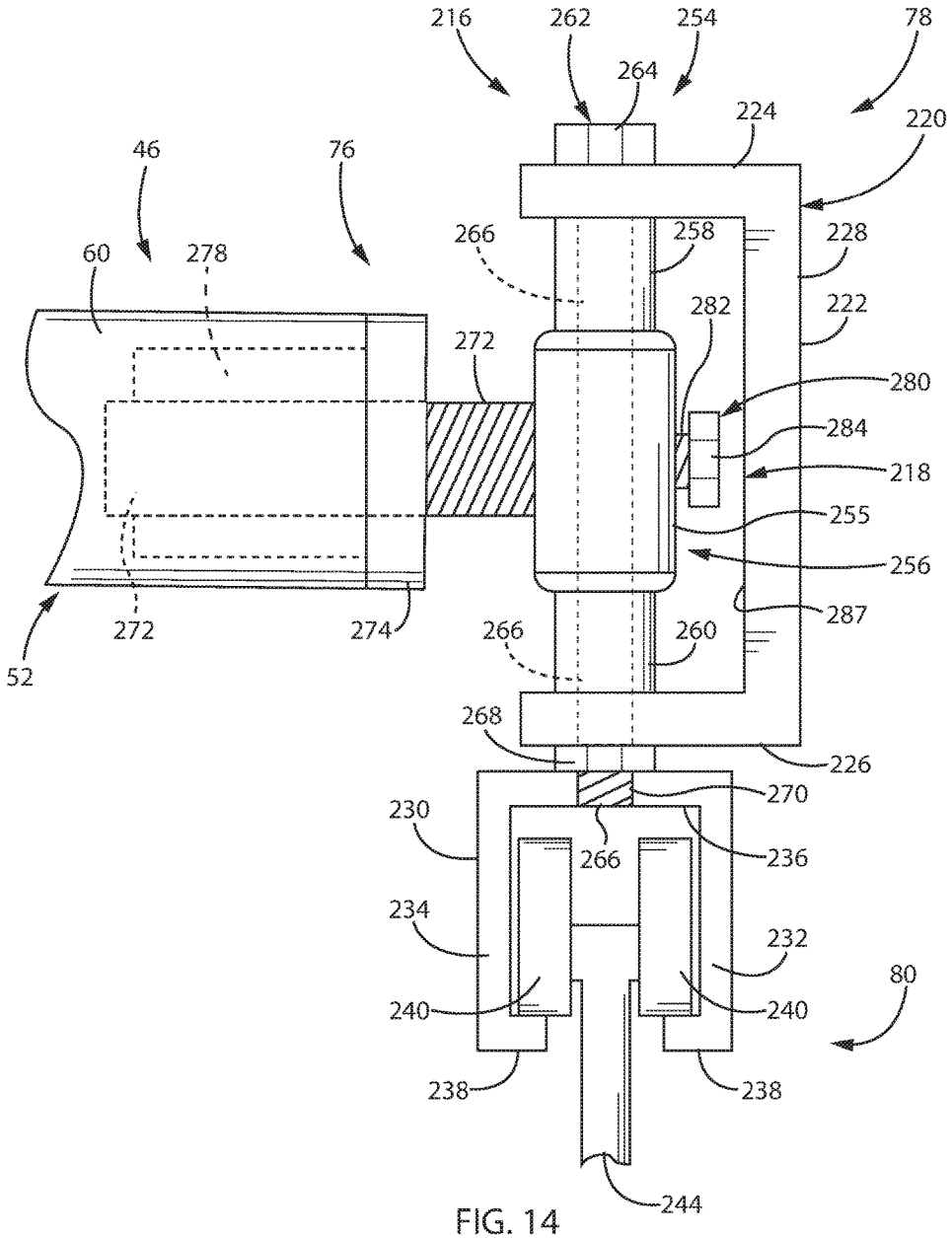
FIG. 14 is an enlarged end view of the swing arm carriage with the pivot limiter in a pivot permitting position disposed from the pivot stop position where the limiter is spaced from the carriage allowing limited relative pivotal movement between the boom and carriage.

The carriage 78 includes an elongate generally horizontally extending swing arm connecting link 220 which can be formed of a substantially rigid elongate beam 222 that can be of C-shaped or of C-channel construction having upper and lower generally parallel upper and lower flanges 224 and 226 between which an endwall 228 extends. An elongate cover hanger track 80 is carried by the carriage 78 and disposed underneath the swing arm connecting link 220. As is best shown in FIGS. 13 and 14, the track 80 is connected to the lower flange 226 of the swing arm connecting carriage beam 222 at a plurality of spaced apart locations along the length of the beam 222 and track 80. The track 80 can be fixed to the carriage 78 or can be attached in a manner that permits some pivotal relative movement therebetween.

The cover hanger track 80 preferably is formed of an elongate beam 230 that preferably is generally C-shaped having a pair of track sidewalls 232 and 234 spaced apart by an endwall 236 disposed adjacent the carriage beam 222. Each track sidewall 232 and 234 has an inturned track-forming flange 238 on which a respective wheel 240 (or roller) of a series of paired wheels 240 of a movable or translatable cover suspension arrangement 242 guided by the track 80. A T-shaped hanger tab 244 rotatively carried by each pair of wheels 240 hangs downwardly and can be connected by a connector 246 to a hanger strap 248 that is in turn can be connected by another connector 250 attached to a reinforced top section 252 at the top of the cover 42. Each connector 246 and 250 can be an S-hook and each strap 248 can be of elastomeric or stretchable construction with a preferred strap being formed of an elastomeric, e.g., rubber, bungee cord. Use of such elastomeric or stretchable straps 248 advantageously helps dampen and absorb some of the forces encountered by a cover 42 suspended therefrom. Such a translatable cover suspension arrangement 242 enables the cover 42 suspended from swing arms 46 of a covering system 40 constructed in accordance with the invention to be extended substantially the length of the track 80 between a covering position, such as shown in FIGS. 1 and 2, and be retracted toward one end of the track 80, such as depicted in FIG. 3 to a removed position. Such a cover 42, track 80, and translatable cover suspension arrangement 242 can be constructed in accordance with that shown and described in U.S. Patent Application Publication No. 2009/0293797 of commonly owned U.S. patent application Ser. No. 12/426,241, expressly incorporated by reference herein.

Each swing arm 46 is attached to the carriage 78 by a pivot assembly 216 that attaches the end 76 of the swing arm boom 60 to an adjacent part of the carriage 78 in a manner permitting relative pivotal motion along a pivot axis that is generally perpendicular to the boom 60 and that preferably is generally vertical. Each pivot assembly 216 includes an elongate generally vertically extending pivot pin 254 that extends through the upper carriage beam flange 224, through a pivot knuckle 255 of a boom coupling 256 used to attach the pivot assembly 216 to the swing arm boom 60, and through the lower carriage beam flange 226. The pivot assembly 216 can include a pair of generally cylindrical spacers 258 and 260 with one of the spacers 258 disposed above the knuckle 255 and the other one of the spacers 260 disposed below the knuckle 255 helping to space the knuckle 255 between the upper and lower flanges 224 and 226 while permitting relative rotational movement therebetween.

As is best shown in FIG. 14, the pivot pin 254 preferably is a bolt 262, such as a hex head bolt, which has a head 264 from which an elongate threaded stem 266 outwardly extends through flange 224, spacer 258, knuckle 255, spacer 260, and flange 226 that is secured by a nut 268 that threadably engages part of the stem 266 extending outwardly beyond the lower flange 226. The free end of the threaded stem 266 of the pivot bolt 262 can be threadably received in a threaded bore 270 formed in the track end wall 236 attaching the track 80 to the carriage 78 in the manner shown in FIG. 14. The nut 268 can also function as a spacer that spaces the track 80 from the carriage 78 by spacing the track endwall 236 from the carriage beam lower flange 226. If desired, one or more washers (not shown) can be disposed between the nut 268 and the carriage beam lower flange 226 and can be disposed between the nut 268 and the track endwall 236.

With continued reference to FIG. 14, the boom coupling 256 is attached to the swing arm boom 60 at or adjacent the free end 76 of the boom 60 in a manner that enables the distance between the hinge knuckle 255 and the end 76 of the boom 60 to be adjusted such as to help ensure that the carriage 78 and track 80 desirably locate the cover 42 over the boat 44 when the covering system 40 is disposed in the covered position. A preferred boom coupling 256 includes an elongate threaded stem 272 that is threadably received in an end cap 274 fixed to the free end 76 of the boom 60 of the swing arm 46. The threaded stem 272 can be rotated in one direction to move the knuckle 255 and hence the carriage 78 (and the track 80) closer to the end 76 of the boom 60 and can be rotated in an opposite direction to move the knuckle 255 and hence the carriage 78 (and the track 80) farther away from the end 76 of the boom 60. Such an adjustable boom coupling 256 advantageously enables the cover 42 to be adjustably positioned closer to or farther away from the end 76 of each boom 60 of each swing arm 46 of the covering system 40 to very precisely locate the cover over the boat 44 when the swing arms are disposed in the covered position.

The end cap 274 can include an elongate generally cylindrical threaded sleeve 278 telescopically received in the tubular boom 60 that is substantially immovably fixed to the boom 60 in a manner enabling a threaded stem 272 of the coupling 256 long enough to provide at least a plurality of inches of adjustment. In one embodiment, the stem 272 is at least two inches long enabling the distance between the carriage 78 (and track 78) and end 76 of boom 60 to be adjusted by at least one inch. In another embodiment, the stem 272 is at least three inches long enabling at least two inches of position adjustment. In still another embodiment, the stem 272 is at least four inches long enabling at least three inches of position adjustment. In a further embodiment, the stem 272 is at least six inches long providing at least five inches of position adjustment.

Figure 15:
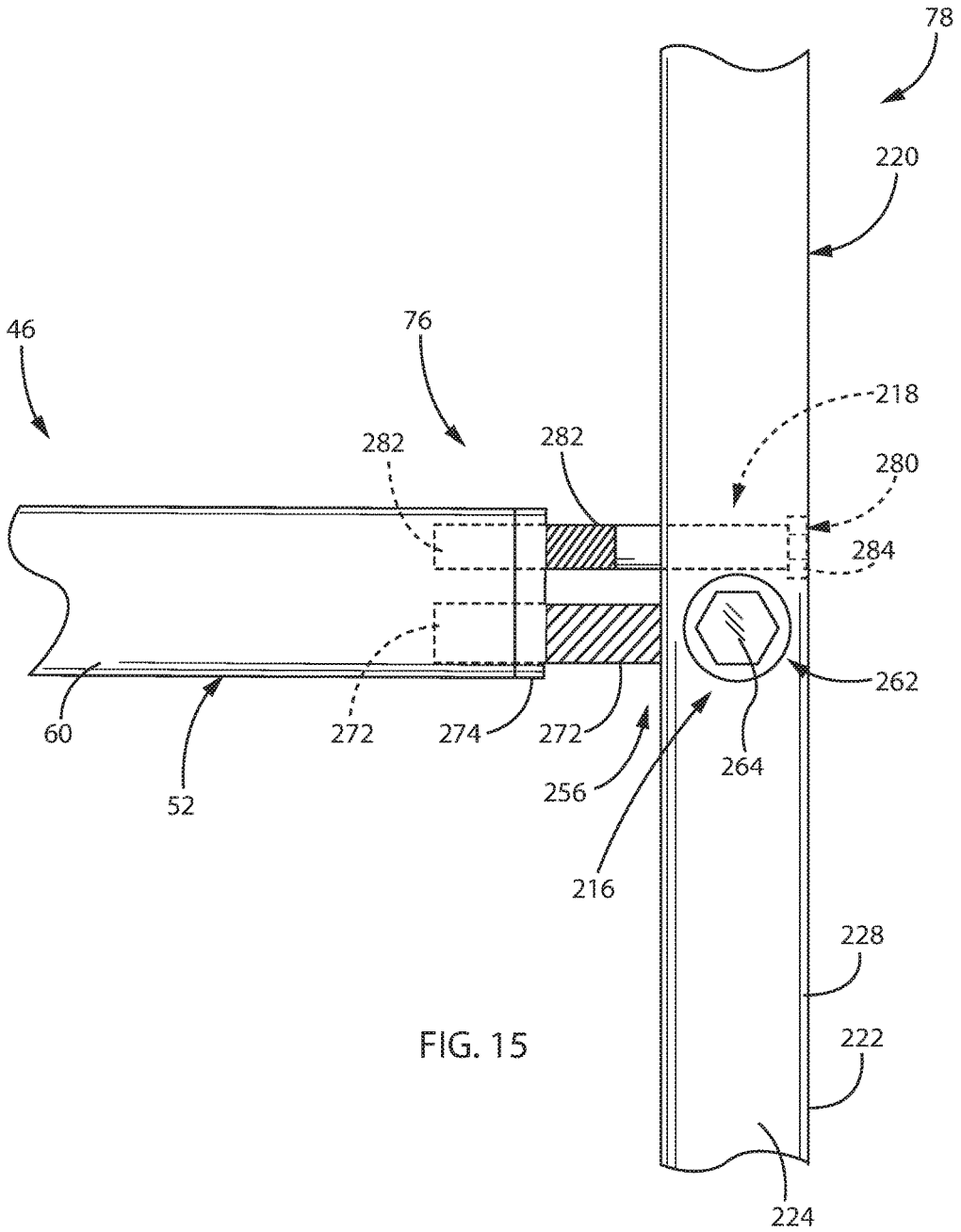
FIG. 15 is a first fragmentary top plan view of part of the boom and carriage illustrating the pivot assembly along with the pivot limiter in the pivot stop position.
Figure 16:
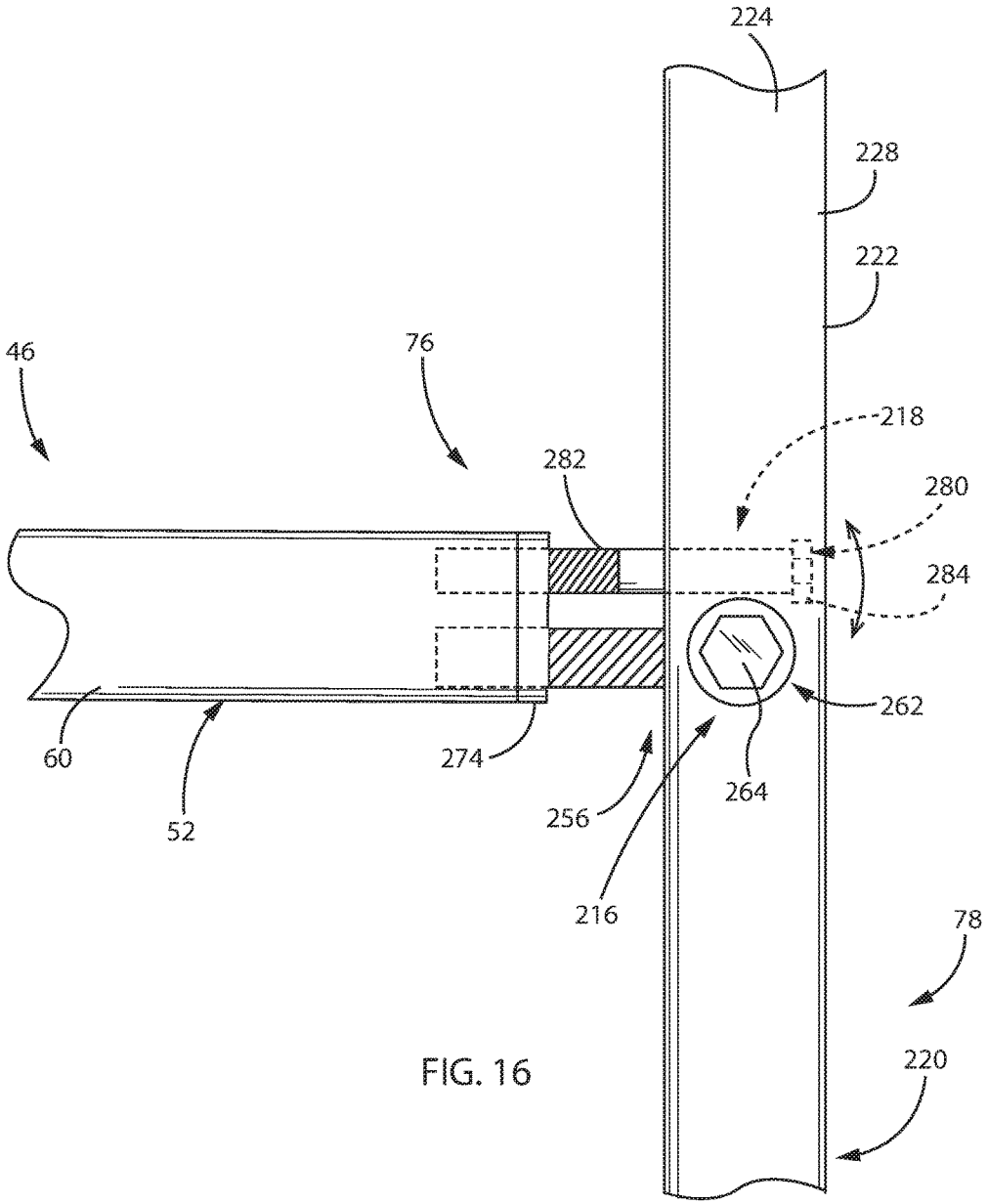
FIG. 16 is a first fragmentary top plan view of part of the boom and carriage illustrating the pivot limiter in a pivot permitting position.

FIGS. 15 and 16 illustrate the pivot limiter 218 in more detail including that it can be adjusted and set, such as depicted in FIGS. 14 and 16, to allow some rotation such as where it is desired to allow the carriage 78 (and track 80) to pivotally "float" relative to the boom 60 of one or more of the swing arms 46. This can desirably help accommodate some movement of the cover 42 due to wind, rain, waves and the like while covering a boat 44 when the swing arms 46 of the covering system 40 is disposed in the covered position. If desired, the limiter 218 can also be set, such as shown in FIGS. 13 and 15, to minimize and even substantially prevent relative rotational movement of the carriage 78 (and track 80) relative to the boom 60 of one or more of the swing arms 46.

In a preferred embodiment, the limiter 218 is a bolt 280 having a threaded stem 282 threadably engaged with the boom end cap 274 that extends alongside the stem 272 of the boom coupling 256 generally parallel thereto having a head 284 that defines a stop that bears against an inner surface 287 of the carriage beam endwall 228 to limit carriage rotation. The bolt 280 can be rotated to adjust the spacing of the head 284 from the carriage beam endwall 228 to change the amount of pivot relative movement permitted. Where substantially no rotation or relative pivotal movement is desired, the bolt 280 can be extended outwardly from the boom end cap 274 until the bolt head 284 abuts against the carriage beam endwall 228, such as in the manner depicted in FIGS. 13 and 15. Of course, where some relative rotation or pivotal movement is permitted or even desired, the bolt 280 can be retracted into the boom end cap 274 until there is some space between the bolt head 284 and carriage beam endwall 228, such as in the manner depicted in FIGS. 14 and 16. The bolt 280 can be rotated as needed to adjust the amount of space to adjust and thereby control the amount of permitted relative pivotal movement.

During operation, with the swing arm rotation lock 136 of each swing arm 46 unlocked, an elongate handle 286 pivotally connected by a collar 288 fixed to at least one of the swing arms 46 is pivoted from a stowed position, like that shown in FIG. 1, away from the swing arm 46 to an operating position like that shown in phantom in FIG. 1. In the preferred covering system rotation handle 286 shown in FIGS. 1 and 3, the handle 286 is an elongate bar or tube that is pivotally attached at one end to collar 288 fixed to the pole 56 of at least one of the swing arms 46. In use, the handle 286 is pivoted away from the stowed position shown in FIG. 1 where the handle 286 is generally parallel to the pole 56 toward an operating position shown in phantom in FIG. 1 where the handle 286 is cantilevered outwardly from the pole 56 generally perpendicular to the pole 56.

The handle 286 is then grasped by a person standing on the deck 86 of the dock 82 and urged in one direction generally parallel to the deck 86 causing the handle 286 to function as a lever arm that causes the shaft 52 of the swing arm 46 to which the handle 286 is attached to rotate. As the shaft 52 begins to rotate, the pivotal connection between the boom 60 of each swing arm 46 and the carriage 78 causes the carriage 78 to act as a substantially rigid connecting link that causes each swing arm 46 pivotally connected to the carriage 78 to substantially simultaneously rotate in the same direction as the swing arm 46 to which the handle 286 is connected.

Understandably, the present invention has been described above in terms of one or more preferred embodiments and methods. It is recognized that various alternatives and modifications may be made to these embodiments and methods that are within the scope of the present invention. Various alternatives are contemplated as being within the scope of the present invention. It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the invention.

What is claimed is:

1. A covering system for removably covering an object alongside a structure comprising:

a plurality of spaced apart swing arms rotatively supported by the structure, each swing arm extending upwardly and outwardly therefrom to a free end of the swing arm;

carriage pivotally interconnecting each one of the swing arms;

a cover hanging downwardly from at or adjacent the free end of the swing arm, the cover carried by the carriage; and a pivot limiter extending from at least one of the swing arms, the pivot limiter having a stop that is (i) displaced away from the swing arm and toward the carriage into engagement with the carriage in a pivot-limiting position opposing pivoting of at least one of the swing arms relative to the carriage, and (ii) displaced toward the swing arm and away from the carriage towards a pivot-permitting position disengaging the pivot limiter from the carriage permitting pivoting of the at least one of the swing arms relative to the carriage;

wherein the plurality of swing arms rotate between a covered position where the cover generally overlies the object to be covered with the cover and an uncovered position disposed from the covered position where the object is uncovered.

2. The covering system of claim 1, wherein the pivot limiter comprises a free end defining a pivot stop that abuts a portion of the carriage when extended outwardly from the at least one of the swing arms into engagement with the portion of the carriage.

3. The covering system of claim 2, wherein the pivot limiter further comprises a bolt having a threaded stem that is extended outwardly from the at least one of the swing arms into engagement with the portion of the carriage with the free end that abuts the portion of the carriage preventing pivoting of the carriage relative to at least one of the swing arms.

4. The covering system of claim 2, further comprising a pivot assembly pivotally connecting the free end of each swing arm to the carriage.

5. The covering system of claim 4, wherein each pivot assembly comprises a pivot knuckle pivotally connecting a corresponding one of the swing arms to the carriage.

6. The covering system of claim 5, wherein the carriage comprises an elongate and substantially straight carriage beam.

7. The covering system of claim 6, wherein each swing arm has a generally vertically extending portion and a generally horizontally extending portion, the free end of each swing arm comprising a free end of the generally horizontally extending portion.

8. The covering system of claim 1, wherein the pivot limiter extends outwardly from a free end of the at least one of the swing arms.

9. The covering system of claim 8, wherein the pivot limiter has a free end defining a pivot stop that abuts a portion of the carriage when extended outwardly from the at least one of the swing arms into engagement with the portion of the carriage.

10. A covering system for removably covering an object alongside a structure comprising:

a plurality of spaced apart swing arms rotatively carried by the structure, each swing arm having a generally upwardly extending section and a generally outwardly extending section terminating in a free end of the swing arm;

a downwardly-hanging cover hanging carried by the generally outwardly extending section of the plurality of the swing arms; and a plurality of spaced apart swing arm mounting arrangements, each swing arm mounting arrangement comprised of at least one swing arm mount mounted to the structure and which is configured to (a) position-adjustably support the generally upwardly extending section of a corresponding one of the plurality of the swing arms enabling adjustment of a generally horizontal distance of the generally upwardly extending section of the corresponding one of the plurality of the swing arms from the structure, and (b) rotatively support the corresponding one of the plurality of the swing arms enabling rotation of the corresponding one of the plurality of the swing arms relative to the object between (i) a covered position where the cover generally overlies the object to be covered with the cover, and (ii) an uncovered position disposed from the covered position where the object is uncovered.

11. The covering system of claim 10, wherein each one of the plurality of swing arm mounting arrangements comprises a generally horizontally extending spacer arm disposed between (i) the at least one swing arm mount mounted to the structure and (ii) the vertically upwardly extending section of the corresponding one of the plurality of swing arms rotatively and position-adjustably supported by the at least one swing arm mount mounted to the structure, and wherein the spacer arm is displaceable relative to the at least one swing arm mount to adjust a generally horizontal distance between the structure and the vertically upwardly extending section of the corresponding one of the plurality of swing arms.

12. The covering system of claim 10, wherein the at least one swing arm mount comprises a spacer arm disposed between the generally upwardly extending section of the corresponding one of the swing arms and the structure, the spacer arm being length adjustable enabling the distance between the generally upwardly extending section of the corresponding one of the swing arms and the structure to be adjusted.

13. The covering system of claim 10, wherein the at least one adjustable swing arm mount further comprises a swing arm shaft holder spaced outwardly of the structure by a spacer arm that spaces an adjacent portion of the generally upwardly extending section of the corresponding one of the swing arms from the structure, and wherein the adjacent portion of the generally upwardly extending section of the corresponding one of the swing arms extends through the swing arm shaft holder and is rotatively supported by the swing arm shaft holder.

14. The covering system of claim 13, wherein the swing arm shaft holder is cantilevered generally horizontally outwardly from the at least one mount by the spacer arm, the spacer arm generally horizontally spacing the adjacent portion of the uprightly extending shaft section from the at least one mount.

15. The covering system of claim 10, wherein the swing arm mount of each one of the plurality of mounting arrangements comprises a bracket mounted to the structure, a threaded bung fixed to the bracket and extending outwardly away from the structure, and a spacer arm having one end threadably received in the threaded bung and carrying a generally circular or cylindrical shaft holder through which an adjacent portion of the generally upwardly extending section of the corresponding one of the plurality of swing arms extends, and wherein rotation of the spacer arm (i) in one direction threadably extends the spacer arm farther from the threaded bung thereby spacing the adjacent portion of the generally upwardly extending section of the corresponding one of the plurality of swing arms farther away from the structure to which the bracket is mounted, and (ii) in an opposite direction threadably retracts part of the spacer arm into the threaded bung thereby spacing the adjacent portion of the generally upwardly extending section of the corresponding one of the plurality of swing arms closer to the structure to which the bracket is mounted.

16. The covering system of claim 10, wherein the structure to which the covering system is mounted comprises a dock or pier supported by a plurality of generally round or cylindrical wooden pilings or posts that are substantially immovably fixed or grounded in place.

17. The covering system of claim 10, wherein each swing arm is rotatively supported by a plurality of vertically spaced apart swing arm shaft holders.

18. The covering system of claim 10, wherein each one of the plurality of swing arm mounting arrangements comprises a pair of vertically spaced apart swing arm mounts each attached to the structure and each having a length-adjustable spacer arm extending generally horizontally outwardly from each one of the vertically spaced apart swing arm mounts that each generally horizontally and adjustably spaces a respective adjacent portion of the vertically extending section of the corresponding one of the plurality of swing arms away from the structure enabling the distance therebetween to be adjusted.

19. The covering system of claim 18, wherein each one of the length-adjustable spacer arms of the swing arm mounts of each one of the plurality of swing arm mounting arrangements is independently length adjustable relative to every other one of the length-adjustable spacer arms of the swing arm mounts of each one of the plurality of swing arm mounting arrangements.

20. A covering system for removably covering an object alongside a structure comprising:

a plurality of spaced apart swing arms rotatively supported by the structure, each swing arm extending upwardly and outwardly therefrom to a free end of the swing arm;

a plurality of spaced apart swing arm mounting arrangements, each swing arm mounting arrangement mounted to the structure and rotatively supporting a corresponding one of the swing arms, wherein each swing arm mounting arrangement is position-adjustable enabling adjustment of a position of the respective swing arm from the structure;

a carriage pivotally interconnecting each one of the swing arms;

a cover hanging downwardly from at or adjacent the free end of the swing arm, the cover carried by the carriage; and a pivot limiter extending from at least one of the swing arms, the pivot limiter having a stop that is (i) displaced away from the swing arm and toward the carriage into engagement with the carriage in a pivot-limiting position opposing pivoting of at least one of the swing arms relative to the carriage, and (ii) displaced toward the swing arm and away from the carriage towards a pivot-permitting position disengaging the pivot limiter from the carriage permitting pivoting of the at least one of the swing arms relative to the carriage;

wherein the plurality of swing arms rotate between a covered position where the cover generally overlies the object to be covered with the cover and an uncovered position disposed from the covered position where the object is uncovered.

* * * * *